US005141219A

United States Patent [19]

Watts et al.

[11] Patent Number: 5,141,219

[45] Date of Patent: Aug. 25, 1992

[54] APPARATUS AND METHOD FOR SEPARATING A STREAM OF LAPPED SIGNATURES INTO DISCRETE BATCHES

[75] Inventors: Leonard A. Watts, Hallandale; Medardo Espinosa, Hialeah, both of Fla.

[73] Assignee: IDAB Incorporated, Hialeah, Fla.

[21] Appl. No.: 433,350

[22] Filed: Nov. 8, 1989

[51] Int. Cl.[5] ..... B65H 29/66

[52] U.S. Cl. ..... 271/203; 271/216; 271/270; 198/419.3

[58] Field of Search ..... 271/202, 203, 216, 270; 198/419.2, 419.3

[56] References Cited

U.S. PATENT DOCUMENTS

| | | | |
|---|---|---|---|
| 1,192,832 | 7/1916 | Sherman | 271/202 |
| 3,072,095 | 1/1963 | Keesen et al. | 271/202 |
| 3,367,474 | 2/1968 | Kerr et al. | 271/202 |
| 3,368,660 | 2/1968 | Standley et al. | 271/202 |
| 3,403,772 | 10/1968 | Vadas | 271/202 |
| 3,406,961 | 10/1968 | Walton | 271/202 |
| 3,506,258 | 4/1970 | Lindquist | 271/202 |
| 3,509,984 | 5/1970 | Hartung et al. | 271/202 |
| 3,688,890 | 9/1972 | Brockmuller | 271/202 |
| 3,861,672 | 1/1975 | Norton | 271/203 |
| 4,043,442 | 8/1977 | Greenwell | 271/202 |
| 4,083,277 | 4/1978 | Lotz | 271/202 |
| 4,180,154 | 12/1979 | Andersson | 198/419.3 |
| 4,238,024 | 12/1980 | Hirakawa et al. | 271/202 |
| 4,313,600 | 2/1982 | Mosburger | 271/203 |
| 4,585,227 | 4/1986 | Muller | 271/202 |
| 4,678,172 | 7/1987 | Faltin | 271/202 |
| 4,725,052 | 2/1988 | Naknishi . | |
| 4,768,642 | 8/1988 | Hunter | 198/419.2 |
| 4,805,890 | 2/1990 | Martin . | |
| 4,948,114 | 8/1990 | Bowman et al. | 271/270 |

FOREIGN PATENT DOCUMENTS

| | | | |
|---|---|---|---|
| 2713895 | 10/1977 | Fed. Rep. of Germany . | |
| 2712677 | 9/1978 | Fed. Rep. of Germany . | |
| 3202444A1 | 8/1982 | Fed. Rep. of Germany . | |
| 8602926 | 6/1988 | Netherlands | 271/202 |
| 1008026 | 10/1965 | United Kingdom . | |
| 2037714A | 7/1980 | United Kingdom . | |

*Primary Examiner*—Robert P. Olszewski
*Assistant Examiner*—Steven M. Reiss
*Attorney, Agent, or Firm*—Finnegan, Henderson, Farabow, Garrett & Dunner

[57] ABSTRACT

A method and apparatus for separating a stream of signatures into discrete batches includes an infeed conveyor transporting signatures at a constant velocity $V_1$, an outfeed conveyor transporting signatures at a higher constant velocity $V_2$, and a plurality of parallel endless belts disposed between the infeed and outfeed conveyors. The plurality of parallel belts each include a raised portion for engaging and transporting signatures. Each belt is independently driven, and the belts are positioned with the raised portions staggered to engage successive portions of the incoming stream of signature. Each belt is driven alternatively at speeds $V_1$ and $V_2$, first matching the infeed velocity and then matching the outfeed velocity. As each successive raised portion fully engages a portion of signatures, it is accelerated to $V_2$, thus introducing a gap between that portion of signatures and the remainder of the stream, which is engaged by the raised portion of the succeeding belt traveling at $V_1$, thus creating a discrete batch. This process continues, repeatedly and successively with each of the belts, thus continuously creating a stream of discrete batches of lapped signatures, each batch being substantially the same length.

45 Claims, 23 Drawing Sheets

APPARATUS AND METHOD FOR SEPARATING A STREAM OF LAPPED SIGNATURES INTO DISCRETE BATCHES

BACKGROUND OF THE INVENTION

1. Field of the Invention

The present invention relates generally to an apparatus and method for separating articles into batches. The invention relates specifically to an apparatus and method for separating a stream of lapped signatures into discrete batches of lapped signatures.

2. Description of the Related Art

When articles are conveyed in a continuous stream, it is often necessary to separate the stream into discrete batches of articles for packaging or other purposes. This is particularly important in the field of newspaper printing. For example, while newspaper presses can produce signatures at rates in excess of 70,000 copies per hour, some downstream equipment, such as tying machines, cannot keep up with such speeds. Other procedures, such as placing top sheets with delivery information on the bundles, also are difficult to accomplish successfully and reliably at high production rates.

Dividing the high speed press output of lapped signatures into two separate streams can reduce the downstream load by 50% per line, and permit slower downstream equipment to successfully and reliably operate while accommodating high press output rates. Further divisions of the press output result in further reductions in the downstream load.

One way to divide the press output is to use gripper conveyors which have a series of grippers. Since each gripper carries an individual signature, gripper conveyors have the inherent ability to divide the stream of signatures by dropping individual signatures off at multiple locations.

Another way to divide the press output is to use belt conveyors which split the stream into discrete batches. In comparison to gripper conveyors, belt conveyors have the advantage of substantially lower cost and maintenance. However, there are drawbacks in attempting to use belt conveyors to divide a stream of signatures. Unlike gripper conveyors, belt conveyors do not have the ability to divide a stream of signatures on a product by product basis. In addition, it is difficult to use belt conveyors to divide a high speed stream of lapped signatures into discrete batches without causing the signatures to pile up, changing or disturbing the lap between signatures, or stopping or varying the flow of signatures at the infeed and at the outfeed.

For example, one known batching device uses an element which penetrates the stream of articles on a belt conveyor to restrain a group of articles and create a discrete batch. Another known device uses two conveyor belts; one conveyor belt restrains a portion of the stream of articles and creates a gap in the stream between the restrained portion and the portion ahead of the restrained portion which proceeds on the other conveyor belt. Both of these devices have the drawback of causing articles in the restrained portion to pile up behind the elements which intercept and restrain the stream.

Another batching device receives a series of articles which fall from an infeed conveyor. The batching device includes a first conveyor having an endless transporting portion which is positioned below the infeed conveyor. The batching device also includes a second conveyor, having a discrete transporting portion which travels on a path above the first conveyor and between the first conveyor and the infeed conveyor. The second conveyor intercepts and initiates the formation of a batch from articles which otherwise would fall on and be transported by the first conveyor.

Such an arrangement requires the transporting portions of the various batching conveyors to be on different levels, with the second conveyor directly above the first conveyor. The arrangement also requires the articles to fall during infeed and changes the spacing or lap of the articles when they fall from the infeed conveyor onto the batching device. It additionally requires the articles to be transported on the batching conveyors at different levels and undergo a change in elevation during discharge to an outfeed conveyor. Finally, it discharges the initial portion of the batch at a slower speed than the final portion of the batch.

The use of conveyors positioned at different levels substantially increases the possibility of misaligned and jammed articles. It presents further problems by requiring wide spacing between the endless conveyor of the batching device and both the infeed and outfeed conveyors to accommodate the cycling of the second conveyor around and directly above the endless conveyor.

Yet another device uses a constant speed conveyor to transport a stream of articles and uses a second conveyor to elevate a portion of the stream higher than the level of the constant speed conveyor. The second conveyor transports the portion of the stream which it carries at a speed which is higher than the speed of the constant speed conveyor. The difference in speed introduces a gap between the signatures traveling on the different speed conveyors. Since this device uses conveyors traveling at different speeds at the outfeed, it causes some batches of signatures to travel at high speeds at the outfeed, and other batches of signatures to travel at low speeds at the outfeed. Such an arrangement requires the two batches to be delivered to different outfeed locations or requires changing the speed of the outfeed conveyor repeatedly between higher and lower speeds.

SUMMARY OF THE INVENTION

It is therefore an object of the present invention to provide an apparatus and method for separating a stream of lapped signatures into discrete batches in a continuous operation without causing signatures in the stream to pile up, changing or disrupting the lap between signatures, or stopping or varying the flow of signatures at the infeed and at the outfeed.

It is a further object of the present invention to transport and separate a stream of lapped signatures without changing the level at which the signatures are conveyed.

It is yet a further object of the present invention to transport and separate a stream of lapped signatures into a uniform series of batches having the same length.

It is also an object of the present invention to separate the stream into discrete batches and continuously deliver the batches to a single outfeed location at a single speed.

Additional objects of the invention will be set forth in the description which follows, and in part will be obvious from the description, or may be learned by practice of the invention. The objects and advantages of the invention may be realized and obtained by means of the instrumentalities and combinations particularly pointed out in the appended claims.

To achieve the foregoing objects, and in accordance with the purposes of the invention as embodied and broadly described herein, an apparatus is provided for separating a stream of signatures into discrete batches. The apparatus includes a plurality of conveyors, each for transporting a portion of the stream of signatures from an infeed location to an outfeed location. Means are provided for repeatedly and successively driving each of the plurality of conveyors alternately at a first speed to engage a portion of the signatures and at a second speed greater than the first speed to separate the portion of signatures which it is engaging from a succeeding portion of signatures being conveyed by another of the plurality of conveyors.

It is preferable that the plurality of conveyors are positioned alongside each other with each conveyor including at least one endless belt having a raised portion for engaging and transporting signatures and a portion which does not engage and transport signatures.

A method is provided for separating a stream of signatures into discrete batches. The method includes the steps of receiving a stream of signatures traveling at a first speed at an infeed location, transporting successive portions of the stream of signatures at the first speed from the infeed location on respective successive conveyors, successively accelerating each portion to a second speed on its respective conveyor while transporting a succeeding portion of signatures on another conveyor at the first speed, to separate it from the succeeding portion and form a discrete batch, and continuously discharging the discrete batches from their respective conveyors at an outfeed location at the second speed.

BRIEF DESCRIPTION OF THE DRAWINGS

The accompanying drawings, which are incorporated in and constitute a part of the specification, illustrate a preferred embodiment of the invention and, together with the general description given above and the detailed description of the preferred embodiment given below, serve to explain the principles of the invention.

DESCRIPTION OF THE PREFERRED EMBODIMENT

Reference will now be made in detail to the present preferred embodiment of the invention as illustrated in the accompanying drawings.

In accordance with the invention a method and apparatus is provided for separating a stream of signatures into discrete batches. The apparatus includes a plurality of conveyors, each for transporting a portion of the stream of signatures from an infeed location to an outfeed location.

Figure 1:
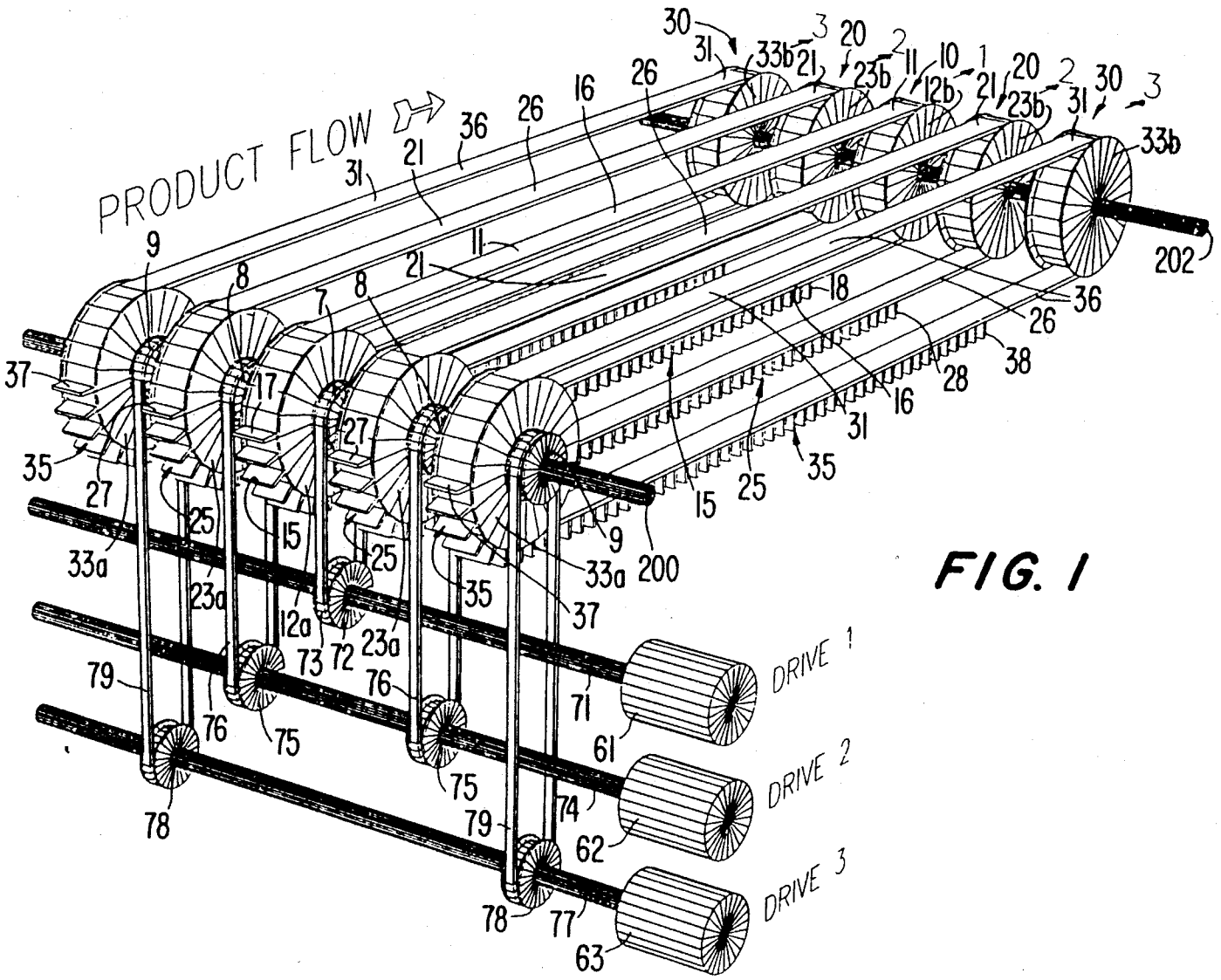
FIGS. 1-10 are perspective isolated views of components of an apparatus for separating a stream of signatures into discrete batches in accordance with the teachings of the present invention, and showing various steps in a process for separating a stream of signatures into discrete batches in accordance with the teachings of the present invention.

As embodied in FIG. 1, the plurality of conveyors include three conveyors 10, 20 and 30, including parallel endless belts 11, 21 and 31 positioned alongside each other and in parallel alignment relative to each other. The first conveyor includes a cogged endless belt 11 which is mounted to be positively driven between a pair of cogged pulleys 12*a* and 12*b*. The second conveyor 20 includes a pair of cogged endless belts 21 which are mounted to be positively driven between respective pairs of cogged pulleys 23*a* and 23*b* so that belts 21 move together in a synchronized manner. The third conveyor 30 includes a pair of cogged endless belts 31, which are mounted to be positively driven between respective pairs of cogged pulleys 33*a* and 33*b* so that belts 31 move together in a synchronized manner. As shown in FIG. 1, the pairs of commonly driven belts are positioned in a bilaterally symmetrical arrangement to evenly support the stream of signatures.

Endless belts 11, 21 and 31 are preferably timing belts and may be made of plastic strips, leather strips, chains, wooden slats or other arrangements known in the art. Pulleys 12*a*, 23*a* and 33*a* are coaxially-mounted to freely rotate on fixed shaft 200. Pulleys 12*b*, 23*b* and 33*b* are coaxially-mounted to freely rotate on fixed shaft 202.

Although circulating endless belts are the presently preferred embodiment, other conveyor systems, such as reciprocating conveyors employing the teachings of the present invention, alternatively may be used.

In accordance with the invention, each of the belts include a portion for engaging and transporting signatures and a portion which does not engage and transport signatures. It is preferable that the portion for engaging and transporting signatures is a raised portion. It also is preferable that all of the belts have similar structure and can function interchangeably. In this regard, the portion of each belt for engaging and supporting the signatures preferably is at the same elevation and is the same length so that each batch may be conveyed at the same elevation and each batch may be the same length.

As embodied in FIG. 1, the portion for engaging and transporting signatures on first conveyor belt 11, is a raised portion 15. The portion of first conveyor belt 11 which does not engage and transport signatures is a lower portion 16. Raised portion 15 is defined by a leading edge 17 and a trailing edge 18, and is preferably formed of series of projecting tabs of rubber which are bonded to a length of an endless strip which forms lower portion 16. Raised portion 15 may alternatively be formed from a continuous strip of rubber which is bonded onto lower portion 16.

Second conveyor belts 21 are similarly configured with raised portions 25 and lower portions 26. Raised portions 25 include leading edges 27 and trailing edges 28. Third conveyor belts 31 are similarly configured with raised portions 35 and lower portions 36. Raised portions 35 include leading edges 37 and trailing edges 38.

Figure 11:
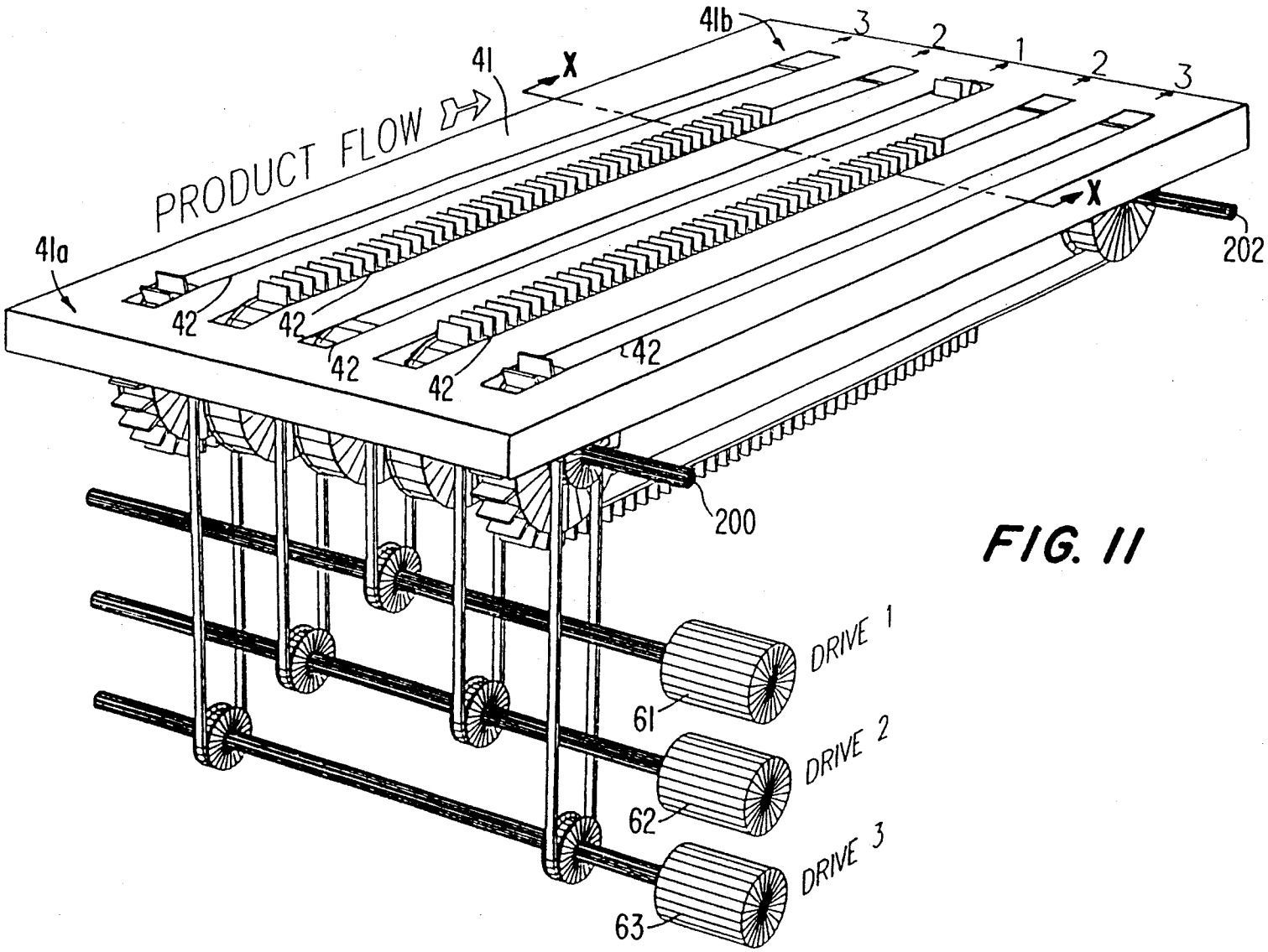
FIG. 11 is a perspective view of the apparatus of FIG. 6 with an additional component.
Figure 12:
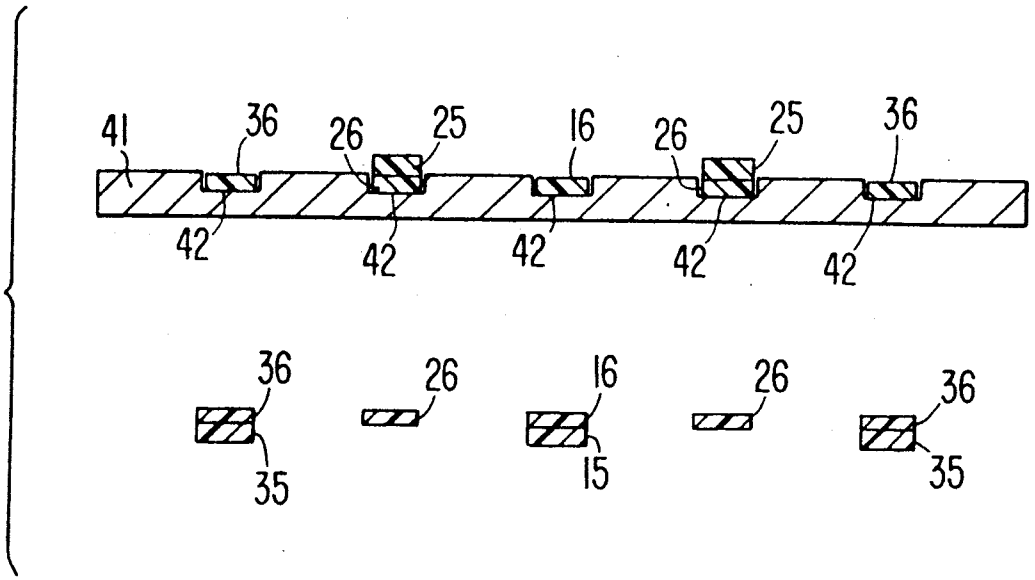
FIG. 12 is a cross-sectional view of the apparatus of FIG. 11 along line X—X.

As shown in FIGS. 11–12, the apparatus preferably includes a table 41 configured with a plurality of parallel channels 42 in its upper surface for supporting the belts and permitting only the raised portion of the belts to extend above the channels. One belt is disposed in each respective channel 42. Each channel 42 has a predetermined depth such that the belts travel in their respective channels. Lower portions 16, 26 and 36 travel below the surface of table 41 and do not engage and transport signatures, while raised portions 15, 25 and 35 project above the surface of table 41 to engage and transport signatures.

In accordance with the invention, each conveyor transports a portion of the stream of signatures from an infeed location to an outfeed location. It is preferable to include means for constantly transporting the signatures to the infeed location at a first speed, and means for constantly transporting signatures from the outfeed location at a second speed. It is also preferable that the portion of each belt for engaging and supporting signatures is at the same elevation as the means for transporting signatures to the infeed location and from the outfeed location.

Figure 13:
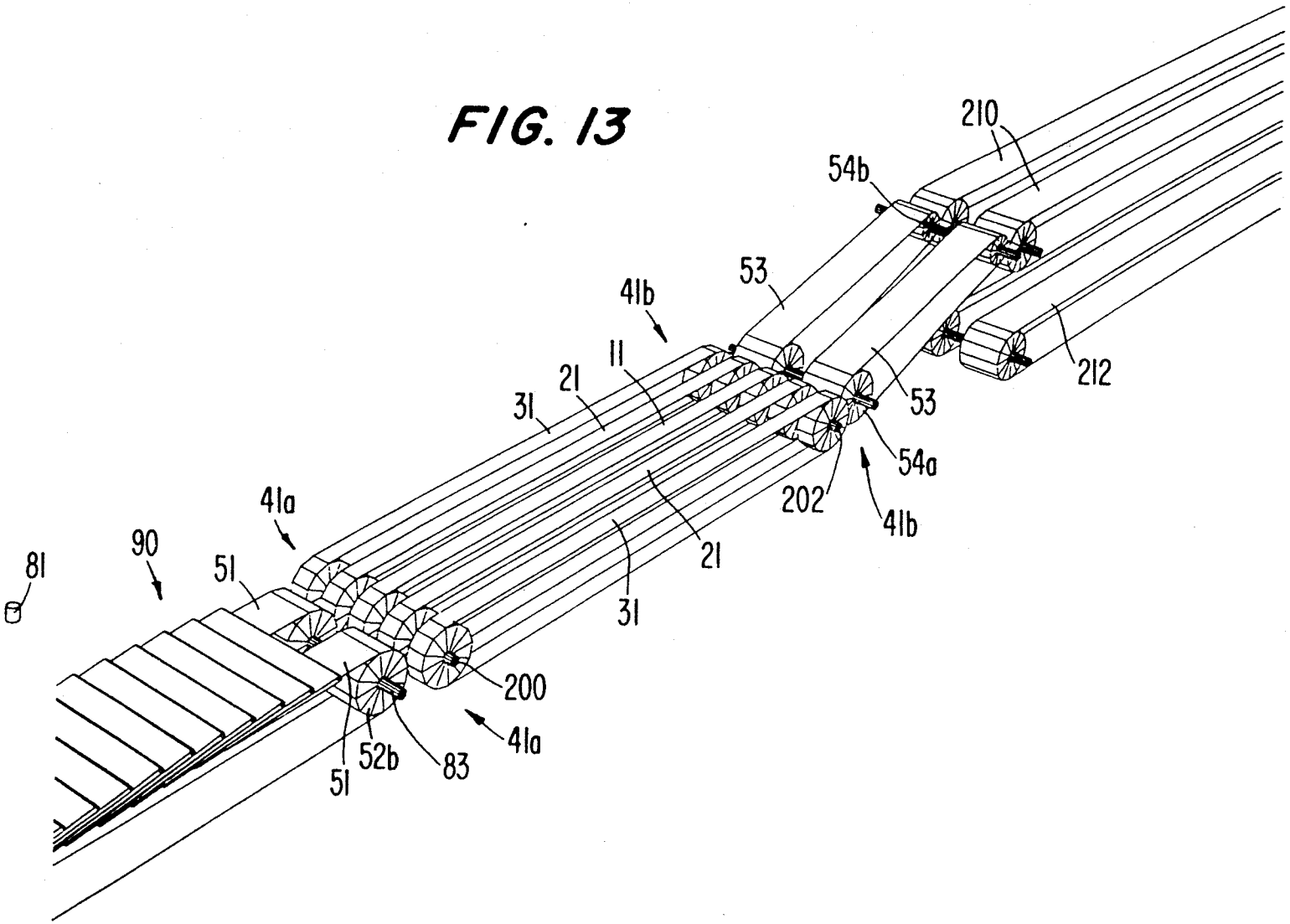
FIGS. 13-20 are perspective views schematically showing various steps in a process for separating a stream of signatures into discrete batches in accordance with the teachings of the present invention.

As shown in FIG. 11, the infeed location 41*a* is at the upstream end of the conveyors 10, 20, and 30 in the area of shaft 200, and the outfeed location 41*b* is at the downstream end of conveyors 10, 20, and 30 in the area of shaft 202. As shown in FIG. 13, the dimensions and relative positioning of belts 11, 21 and 31 allow all of the belts to underlie the stream of signatures which is received.

As shown in FIG. 13, the means for transporting the signatures to the infeed location includes infeed belts 51 disposed upstream of conveyors 10, 20 and 30. The upper transporting surface of infeed belts 51 at the infeed location is aligned horizontally with the upper surface of raised portions 15, 25 and 35 so that the infeed and batching conveyors support and convey the stream of signatures at the same elevation during the transition between those two conveyors. Infeed belts 51 preferably circulate around an upstream pulley (not shown) and downstream pulley 52*b* at a constant first velocity $V_1$.

The means for transporting the signatures from the outfeed location includes outfeed belts 53 disposed downstream of conveyors 10, 20 and 30. The upper transporting surface of outfeed belts 53 at the outfeed location 41*b* is aligned horizontally with the upper surface of raised portions 15, 25 and 35 so that the outfeed and batching conveyors support and convey the stream of signatures at the same elevation during the transition between those two conveyors. Outfeed belts 53 preferably circulate around upstream pulleys 54*a* and downstream pulleys 54*b* at a constant second velocity $V_2$, which is greater than $V_1$.

The term "constant" in the phrases "constant first velocity" and "constant second velocity" is used to mean that during operation, the infeed speed does not substantially alternate between higher and lower speeds to accomplish the batching function and the outfeed speed does not substantially alternate between higher and lower speeds to accomplish or accommodate the batching function. However, it is within the scope of the invention and the term "constant speed" to change the speeds of the batching system to accommodate changes in the speed of incoming product due to changes in speed upstream of the batching system, such as the printing press and folding apparatus which form the stream of lapped signatures.

In accordance with the invention, there is provided means for repeatedly and successively driving each of the plurality of conveyors alternatively at a first speed to engage a portion of the signatures and at a second speed greater than the first speed to separate the portions of signatures which it is engaging from a succeeding portion of signatures being conveyed by another of the plurality of conveyors.

Figure 22:
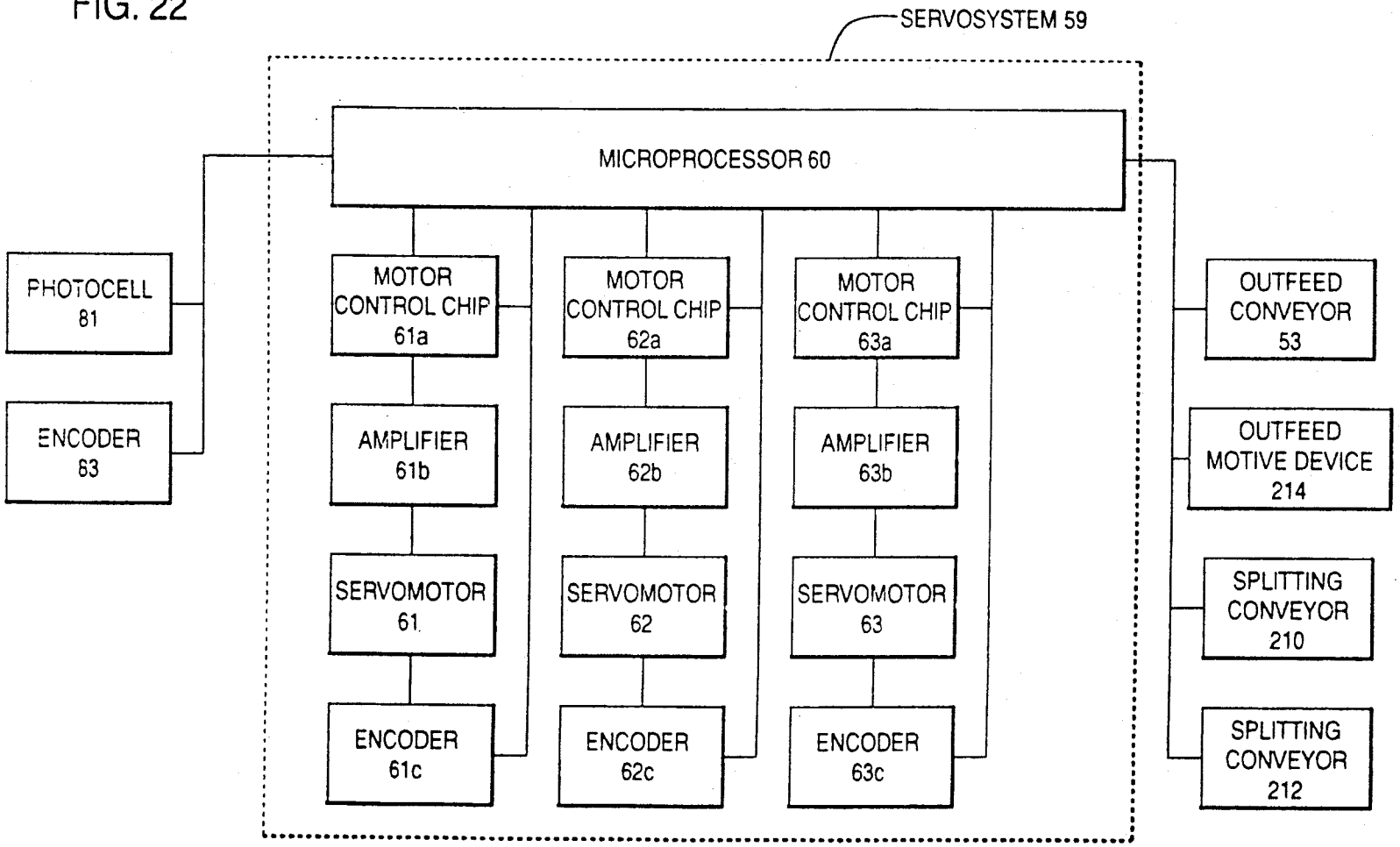
FIG. 22 is a block control diagram.

As embodied in FIGS. 1 and 22, the driving means includes a servosystem 59. Servosystem 59 includes a microprocessor 60 such as Zilog Z-80 microprocessor chip, motor control chips 61*a*, 62*a*, 63*a* such as Hewlett-Packard HCTL-1000 chips, amplifiers 61*b*, 62*b* , 63*b* such as Infranor Inc. model SMVE-2410, servomotors 61, 62, 63 such as PMI Motors model JR12M4CH with encoders 61*c*, 62*c*, 63*c*. As shown in FIG. 22, each servomotor has it own closed loop system. For example, for servomotor 61, microprocessor 60 communicates with motor control chip 61*a* , which communicates with amplifier 61*b*, which communicates with servomotor 61, which is monitored by encoder 61, which provides information back to microprocessor 60 and motor control chip 61*a*. Similar closed looped systems are provided as shown for servomotor 62 and servomotor 63.

Servomotor 61 positively drives first conveyor belt 11 through the following linkage, so that it can be moved independent of the other conveyor belts. Servomotor 61 drives shaft 71 to rotate sprocket 72. Sprocket 72 drives chain 73. Chain 73 drives sprocket 7, which is coaxially fixed to pulley 12*a*. Pulley 12*a* drives first conveyor belt 11.

Servomotor 62 positively drives second conveyor belts 21 through the following linkage, so that they move together, and can be moved independent of the other conveyor belts. Servomotor 62 drives shaft 74 to rotate sprockets 75. Sprockets 75 drive chains 76. Chains 76 drive sprockets 8, which are coaxially fixed to respective pulleys 23*a* . Pulleys 23*a* drive second conveyor belts 21.

Servomotor 63 positively drives third conveyor belts 31 through the following linkage, so that they move together, and can be moved independent of the other conveyor belts. Servomotor 63 drives shaft 77 to rotate sprockets 78. Sprockets 78 drive chains 79. Chains 79 drive sprockets 9, which are coaxially fixed to respective pulleys 33*a*. Pulleys 33*a* drive third conveyor belts 31.

In accordance with the invention, there is provided means for monitoring the speed and presence of the stream of signatures upstream of the infeed location. As shown in FIG. 13, the monitoring means includes photocell 81 positioned proximate to infeed belts 51 to sense the presence of signatures on belts 51. The monitoring means also includes an encoder 83 which indicates the speed of infeed belts 51 which are driven by an infeed belt motor (not shown). Encoder 83 communicates with microprocessor 60. Outfeed belts 53 are driven by an outfeed belt motor (not shown). Microprocessor 60 controls the speed of the outfeed belt motor. As shown in the block control diagram of FIG. 22, microprocessor 60 can monitor the speed and location of the stream of signatures and control the speed of the motors with which it communicates. Servomotors 61, 62, and 63 each receive signals from microprocessor 60 that cause them to operate at times and speeds responsive to the speed and location of the incoming stream.

Encoders 61c, 62c, 63c which respectively monitor servomotors 61, 62, 63, provide pulses which can be utilized to measure the speed and angular position of shafts 71, 74 and 77, and therefore the speed and position of the raised portions 15, 25 and 35 of conveying mechanisms 10, 20 and 30. Each servomotor is capable of alternately driving its respective conveyor mechanism at a lower speed preferably $V_1$, the speed of infeed belts 51, and a higher speed, preferably $V_2$, the speed of outfeed belts 53. Thus, each conveyor 10, 20 and 30 is independently capable of alternating its speed between $V_1$, matching the speed of the infeed belt 51, and $V_2$, matching the speed of the outfeed belt 53.

The previously described apparatus preferably is used with a stream splitting device. The stream splitting device is used to direct batches of signatures in an alternating fashion between a plurality of paths to produce a reduced load on each path. As shown in FIGS. 13-20, the stream splitting device includes two conveyors 210 and 212, downstream of outfeed conveyor 53. It also includes an outfeed motive device 214 (shown schematically in FIG. 22) such as a piston and cylinder for moving the downstream side of outfeed conveyor belts 53 back and forth between the upstream ends of conveyors 210 and 212.

Such a procedure is shown particularly in the sequences between FIGS. 17-18, and FIGS. 19-20. As shown in these figures, the position of the outfeed conveyor belts 53 is changed back and forth between conveyors 210 and 212 each time a gap between batches of signatures occurs at the downstream end of outfeed conveyor belts 53. This allows outfeed conveyor belts 53 to alternate batches between conveyors 210 and 212.

The apparatus for separating a stream of signatures into discrete batches preferably operates in the following manner. A stream of signatures traveling at a first speed are received at the infeed of the batching apparatus. The batching apparatus transports successive portions of the stream of signatures at the first speed from the infeed location on the raised portions of respective successive conveyor belts which are positioned alongside each other.

Each conveyor belt and the signatures which it carries is successively accelerated to a second speed while a succeeding portion of signatures on another conveyor belt is transported at the first speed to separate the accelerated portion from the succeeding portion and form a discrete batch. The discrete batches of signatures are discharged from the outfeed of the batching apparatus at the second speed.

FIGS. 1-10 show the progressive stages of a startup and full running cycle of a three conveyor batching apparatus. These figures show the apparatus without infeed and outfeed conveyors, and without the stream of articles being batched, for purposes of clarity. FIGS. 13-20 show various progressive stages of the batching apparatus with infeed and outfeed conveyors and a stream splitter.

The apparatus starts in the position shown in FIG. 1, where conveyors 10, 20 and 30 with their respective conveyor belts 11, 21 and 31 wait at rest in a ready position with raised portions 15, 25 and 35 in substantial alignment on the underside of the respective conveyor belts. This arrangement corresponds to the stage of operation shown in FIG. 13 where a stream of overlapped signatures 90, traveling at speed $V_1$, approach the batching apparatus on infeed conveyors 51. The leading end of the stream is sensed by photocell 81 when it passes the position of photocell 81.

Figure 2:
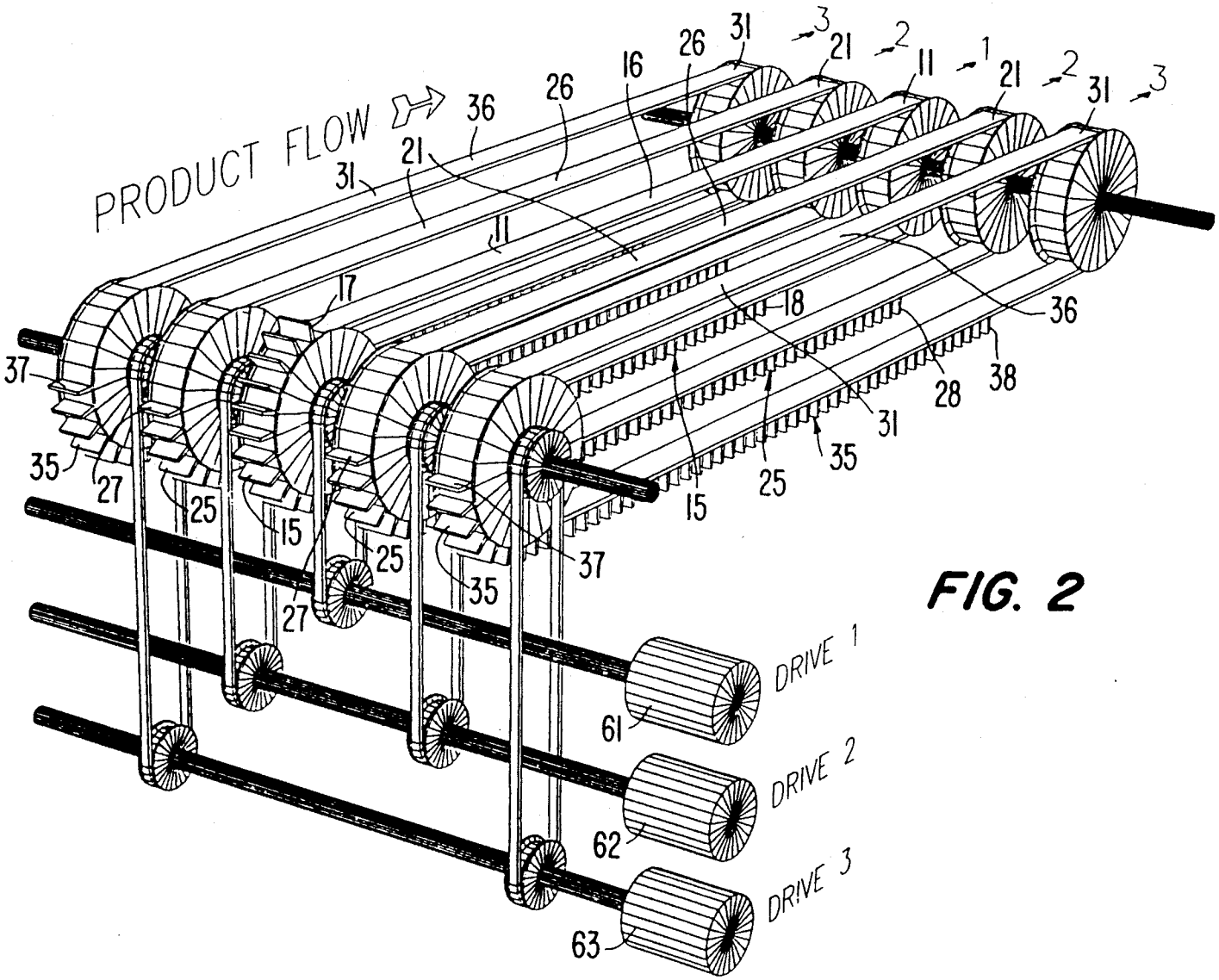

Based on stream position and velocity information supplied to microprocessor 60 by photocell 81 and encoder 83, microprocessor 60 commands first servomotor 61 to accelerate first conveyor belt 11 from a rest position shown in FIG. 1, to a speed of $V_1$ which is reached by the time the conveyors are at the position shown in FIG. 2.

The leading edge 17 of raised portion 15 of first conveyor belt 11 reaches the position shown in FIG. 2 just in time to engage the leading signature of the incoming stream of signatures. Since both the first conveyor belt 11 and the stream of signatures are traveling at speed $V_1$ when they first encounter each other, the signatures undergo no transition in velocity, and the stream progresses essentially undisturbed at speed $V_1$ from the position shown in FIG. 13 (corresponding to the conveyor position shown in FIG. 1) to the position shown in FIG. 14 (corresponding to the conveyor position shown in FIG. 4).

Figure 3:
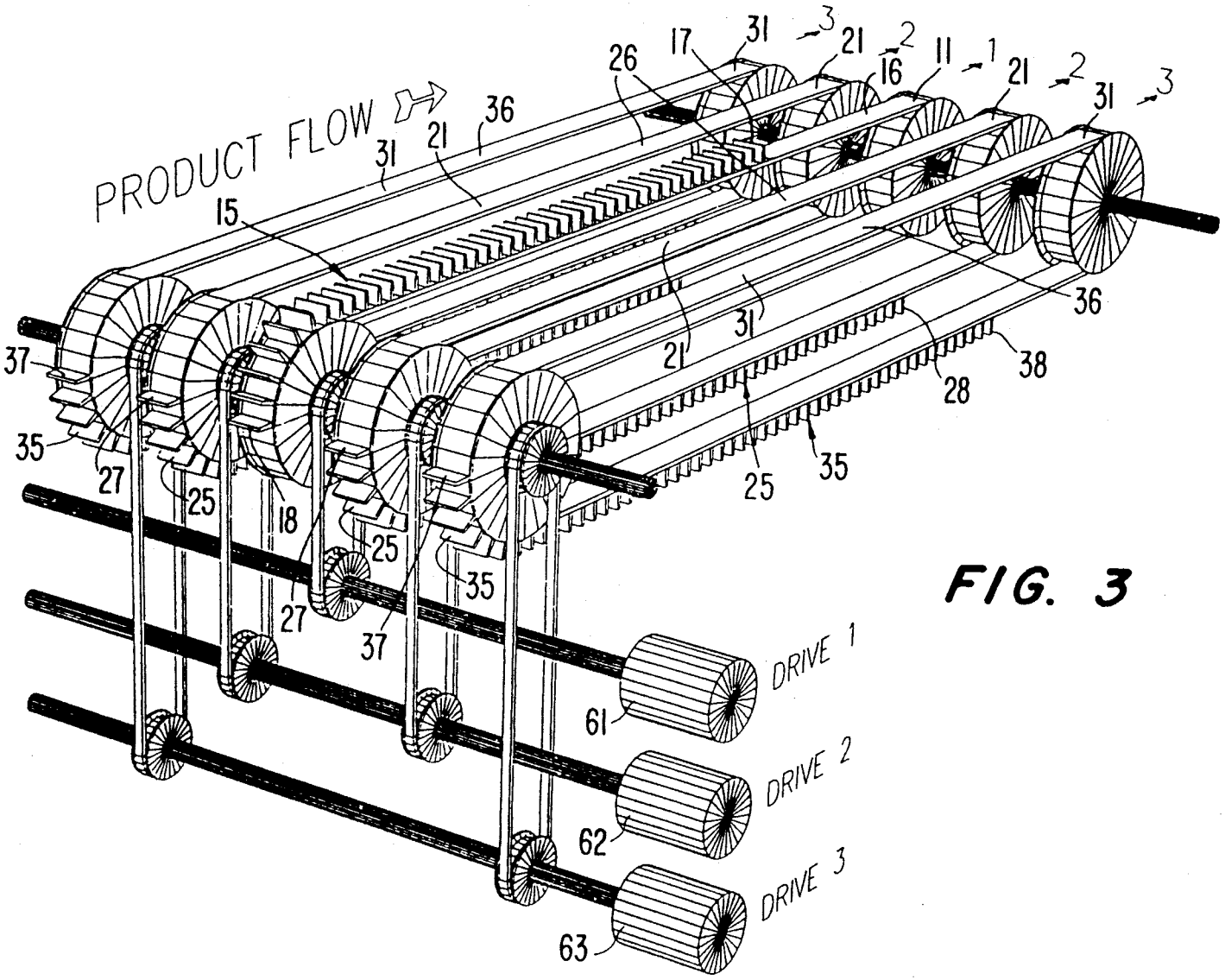
Figure 4:
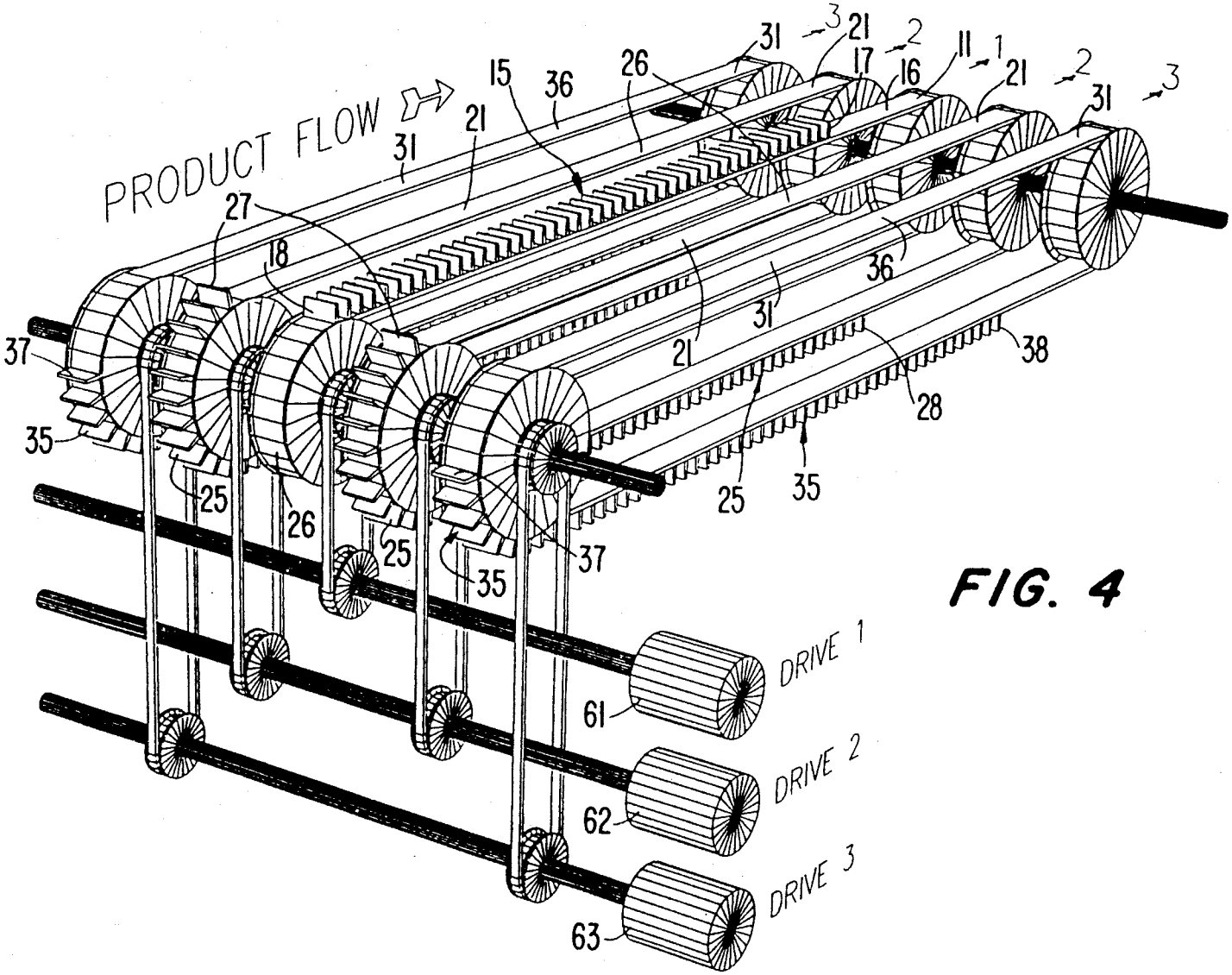

When the conveyors are in the position shown in FIG. 3, microprocessor 60 commands second servomotor 62 to accelerate second conveyor belts 21 from the ready position to speed $V_1$, which is reached by the time the conveyors are in the position shown in FIG. 4. Between the positions shown in FIGS. 3 and 4, leading edges 27 of raised portions 25 of second conveyor belts 21 move substantially in alignment with trailing edge 18 of raised portion 15 of first conveyor belt 11 so that raised portions 25 of second conveyor belts 21 begin engaging signatures without any disruption of the stream 90.

When the conveyors are in the position shown in FIG. 4, and the raised portions 25 of second conveyor belts 21 begin engaging signatures, microprocessor 60 commands first servomotor 61 to accelerate first conveyor belt 11 from speed $V_1$ to speed $V_2$ while continuing to command second servomotor 62 to drive second conveyor belts 21 at the slower speed $V_1$. As first conveyor belt 11 begins to move faster than second conveyor belts 21, a gap 91 begins to grow between the raised portion 15 of first conveyor belt 11 and raised portion 25 of second conveyor belts 21. Accordingly, a gap 91 grows between signatures carried by the raised portion 15 of first conveyor belt 11 and the signatures carried by the raised portion 25 of second conveyor belts 21.

Figure 5:
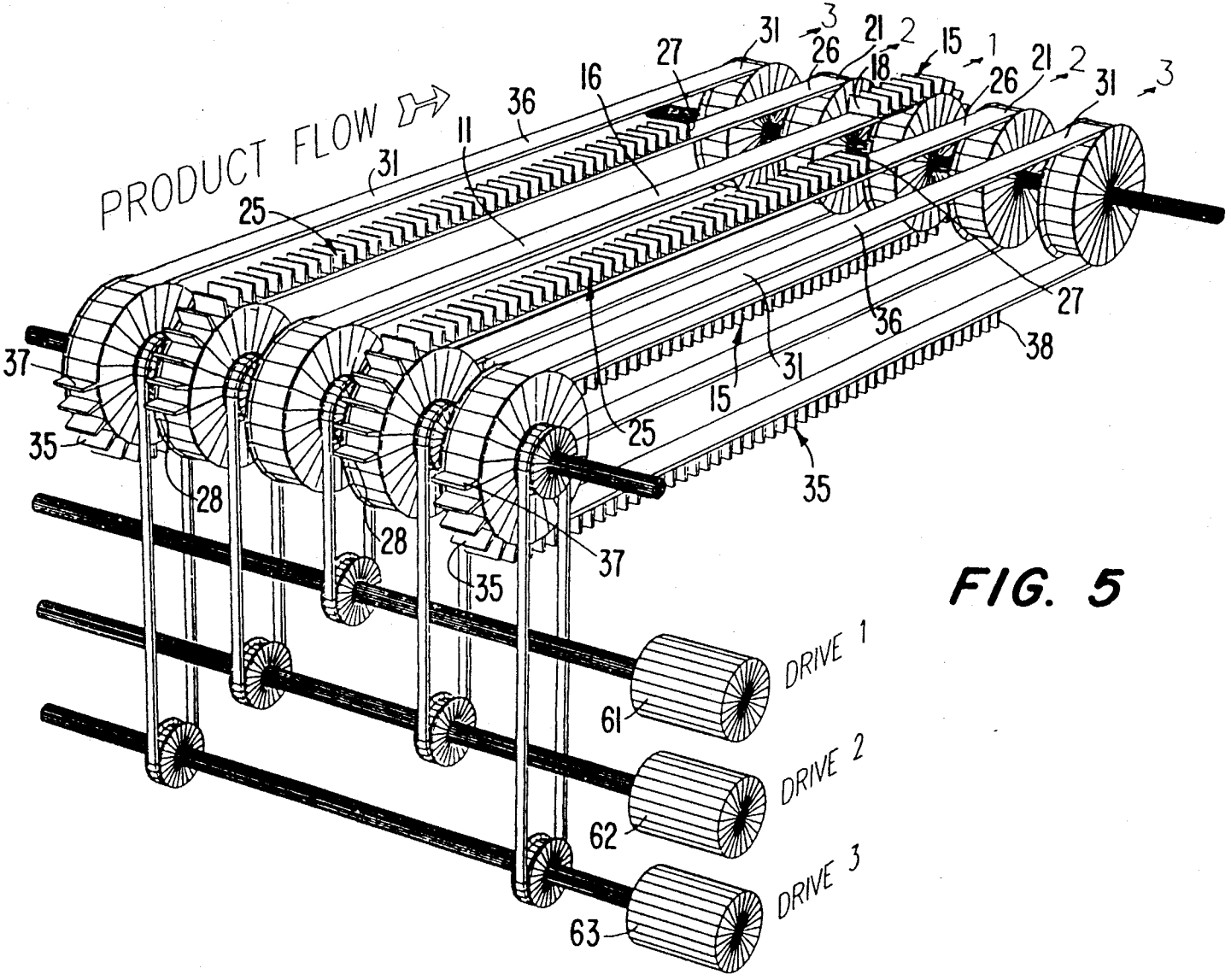
Figure 6:
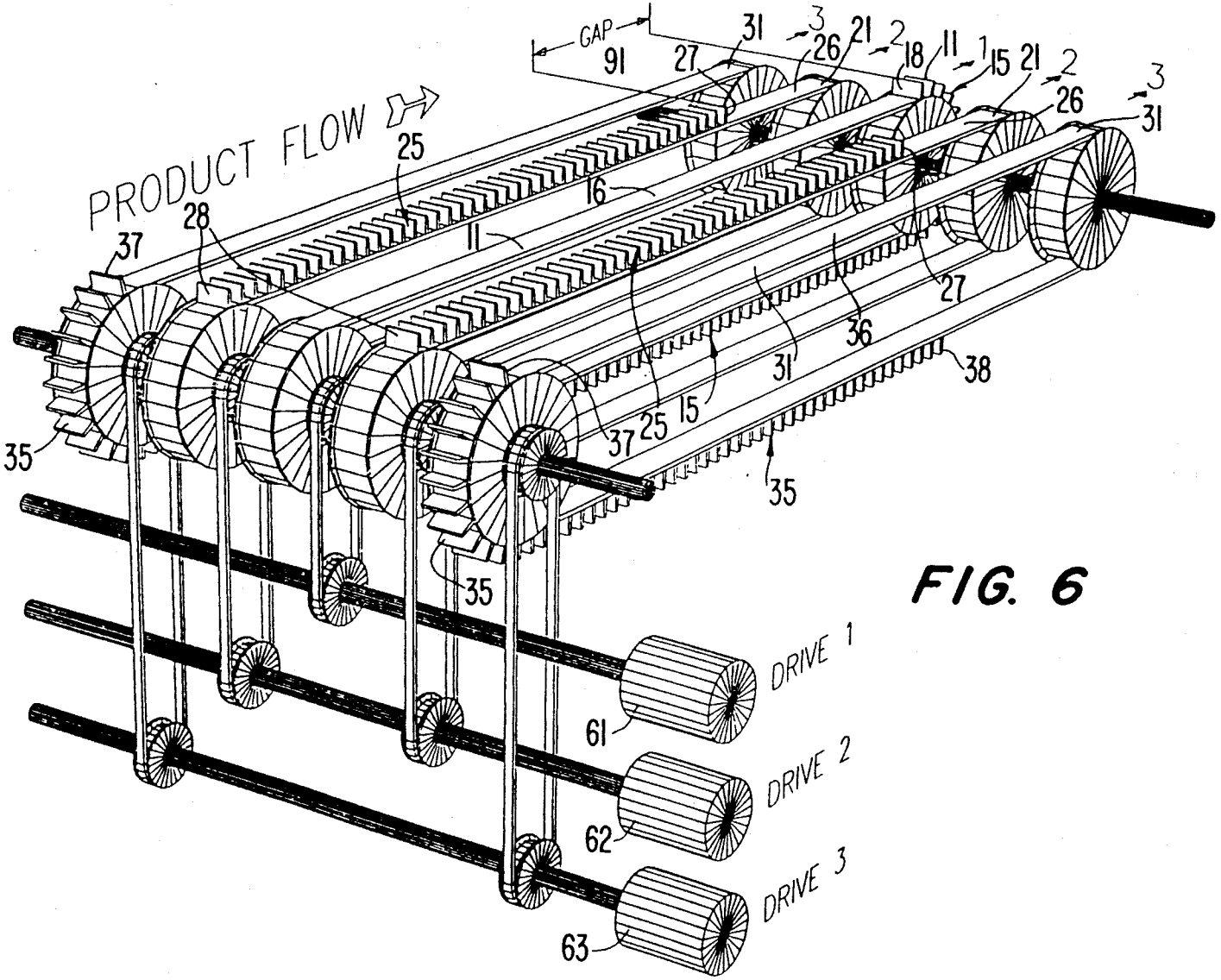

The growth of this gap 91 in the sequence of FIGS. 4, 5 and 6 can be seen by focusing on the growing distance between the trailing edge 18 of the raised portion 15 of the first conveyor belt 11 and the leading edge 27 of the raised portion 25 of the second conveyor belt 21.

Figure 14:
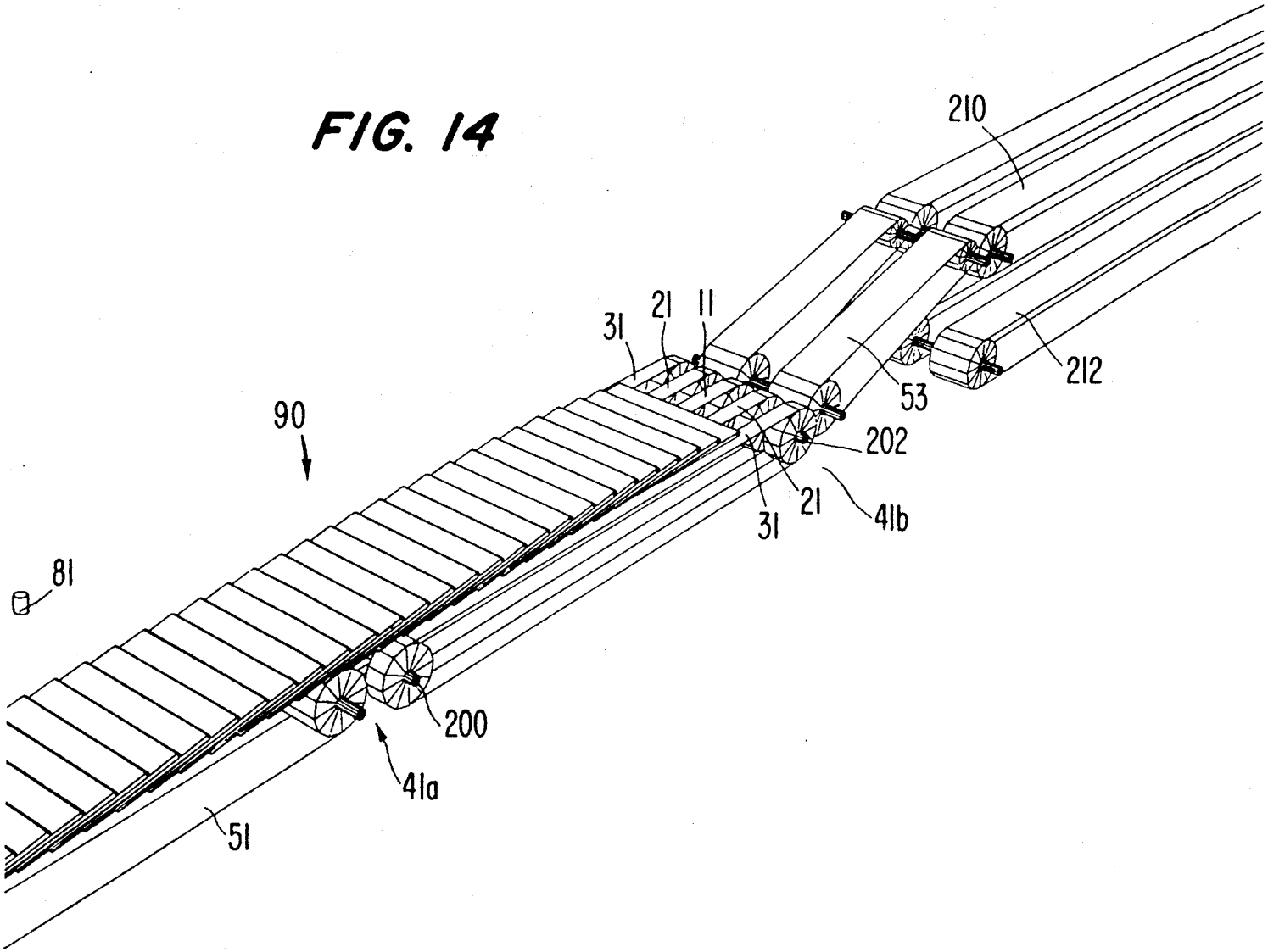
Figure 15:
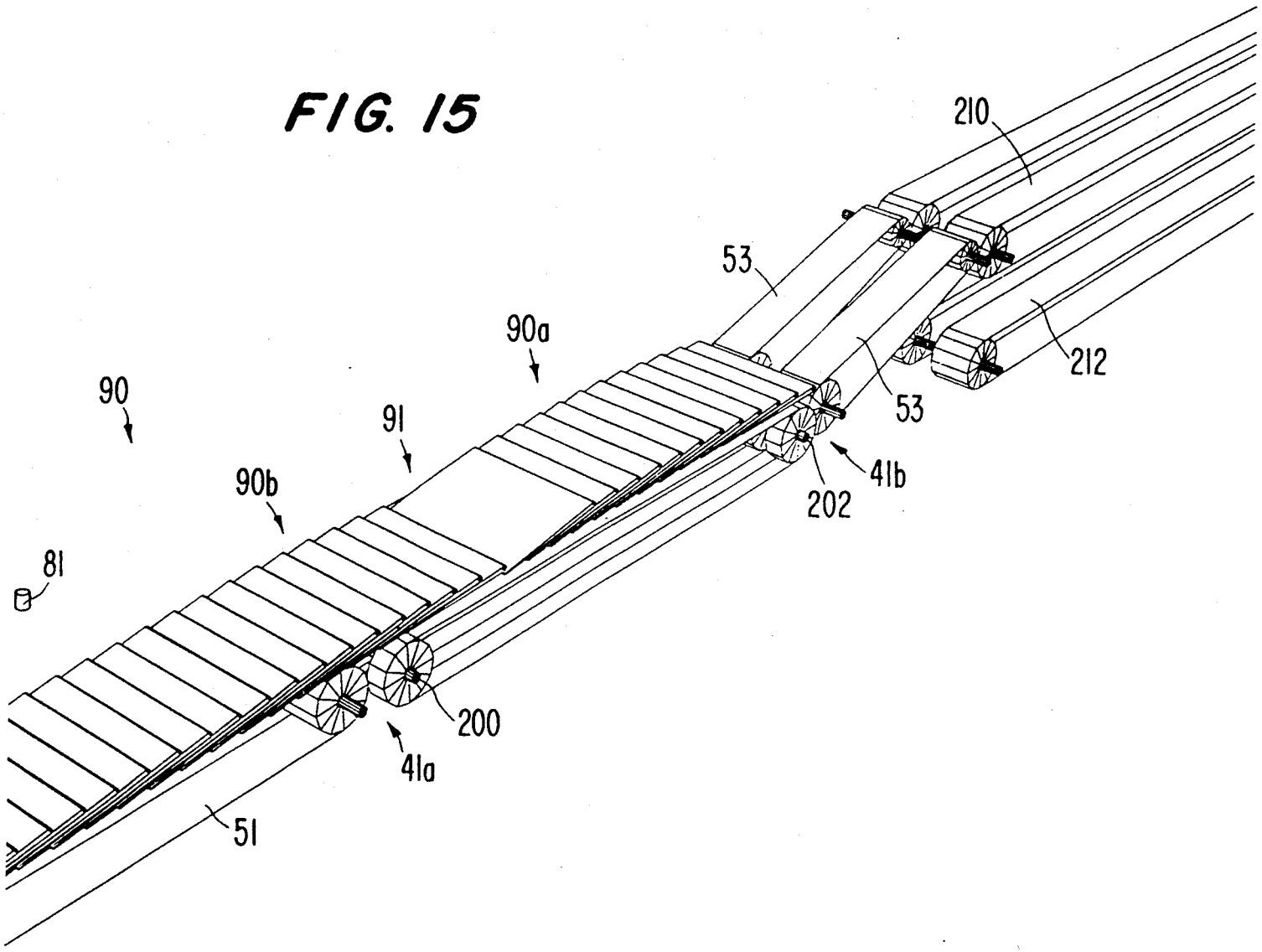

The arrangement of signatures shown in FIG. 14 corresponds to the position of the conveyors shown in FIG. 4, and the arrangement of signatures shown in FIG. 15 corresponds to a subsequent position of the conveyors, somewhere between those shown in FIGS. 4 and 5. As shown in FIG. 15, a first portion **90*a* of signatures is engaged by the raised portion 15 of first conveyor belt 11, and a second portion 90*b* of signatures is engaged by raised portions 25 of second conveyor belts 21. Thus, a first discrete batch of signatures is formed by first portion 90*a* of signatures on first conveyor belt 11**, traveling at speed $V_2$.

Figure 16:
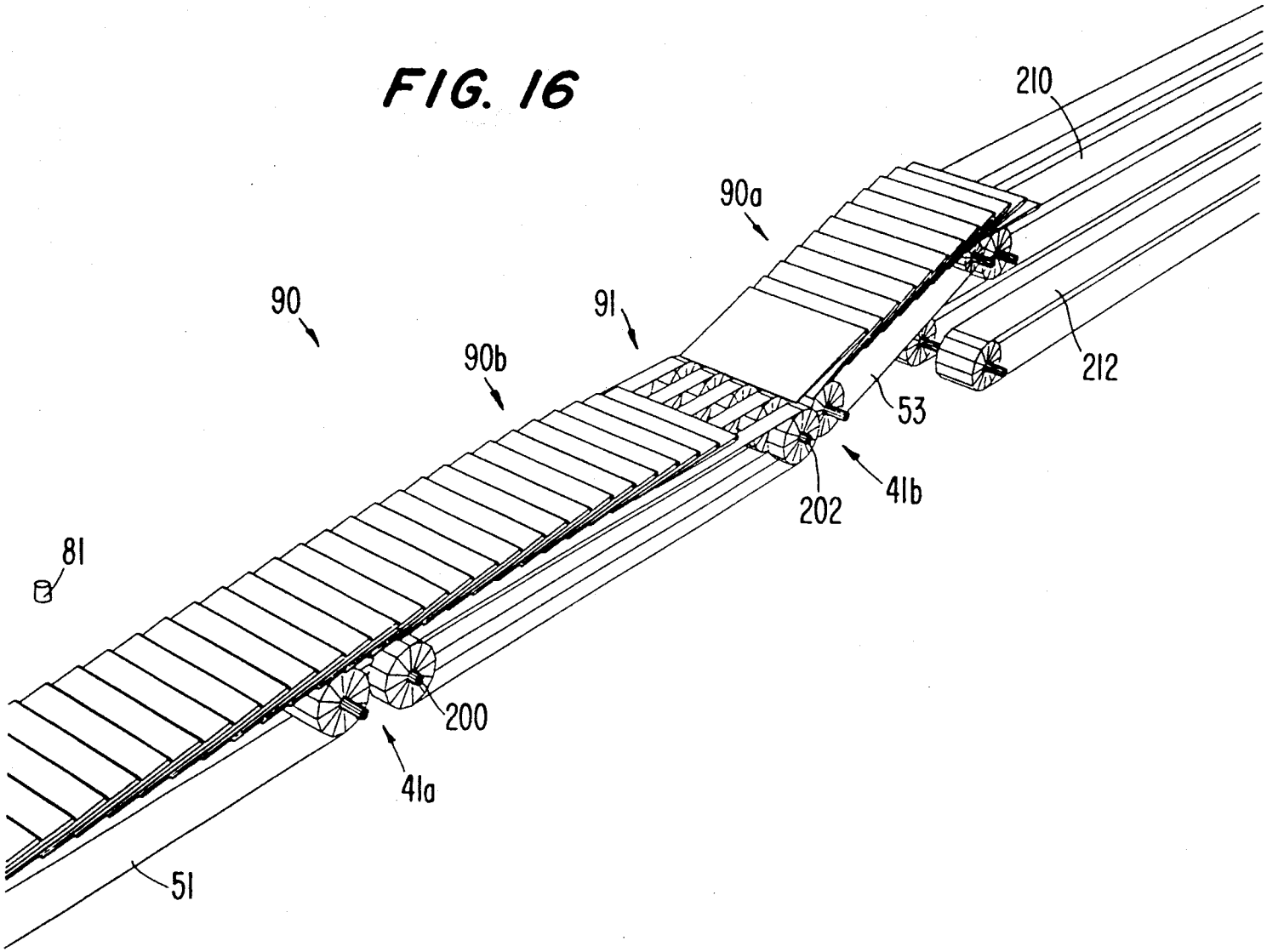

In the sequence between FIGS. 15-16, first conveyor belt 11, traveling at speed $V_2$, discharges the first portion 90*a* of signatures, in the form of a discrete batch, onto outfeed belts 53, which also are traveling at speed $V_2$. During this time, second conveyor belts 21 are traveling at speed $V_1$, and are still receiving, engaging and transporting stream of signatures 90 on raised portions 25.

When the conveyors are in the position shown in FIG. 5, microprocessor 60 commands third servomotor 63 to accelerate third conveyor belts 31 from the ready position to speed $V_1$, which is reached by the time the conveyors are in the position shown in FIG. 6. Between the positions shown in FIGS. 5 and 6, leading edges 37 of raised portions 35 of third conveyor belts 31 move substantially in alignment with trailing edges 28 of raised portions 25 of second conveyor belts 21 so that raised portions 35 of third conveyor belts 31 begin engaging signatures without any disruption of the stream.

When the conveyors are in the position shown in FIG. 6, and the raised portions 35 of third conveyor belts 31 begin engaging signatures, microprocessor 60 commands second servomotor 62 to accelerate second conveyor belts 21 from speed $V_1$ to speed $V_2$ while continuing to command third servomotor 63 to drive third conveyor belts 31 at the slower speed $V_1$. As second conveyor belts 21 begin to move faster than third conveyor belts 31, a gap 92 begins to grow between the raised portions 25 of second conveyor belts 21 and raised portions 35 of third conveyor belts 31. Accordingly, a gap 92 grows between signatures carried by the raised portions 25 of second conveyor belts 21 and the signatures carried by the raised portions 35 of third conveyor belts 31.

Figure 7:
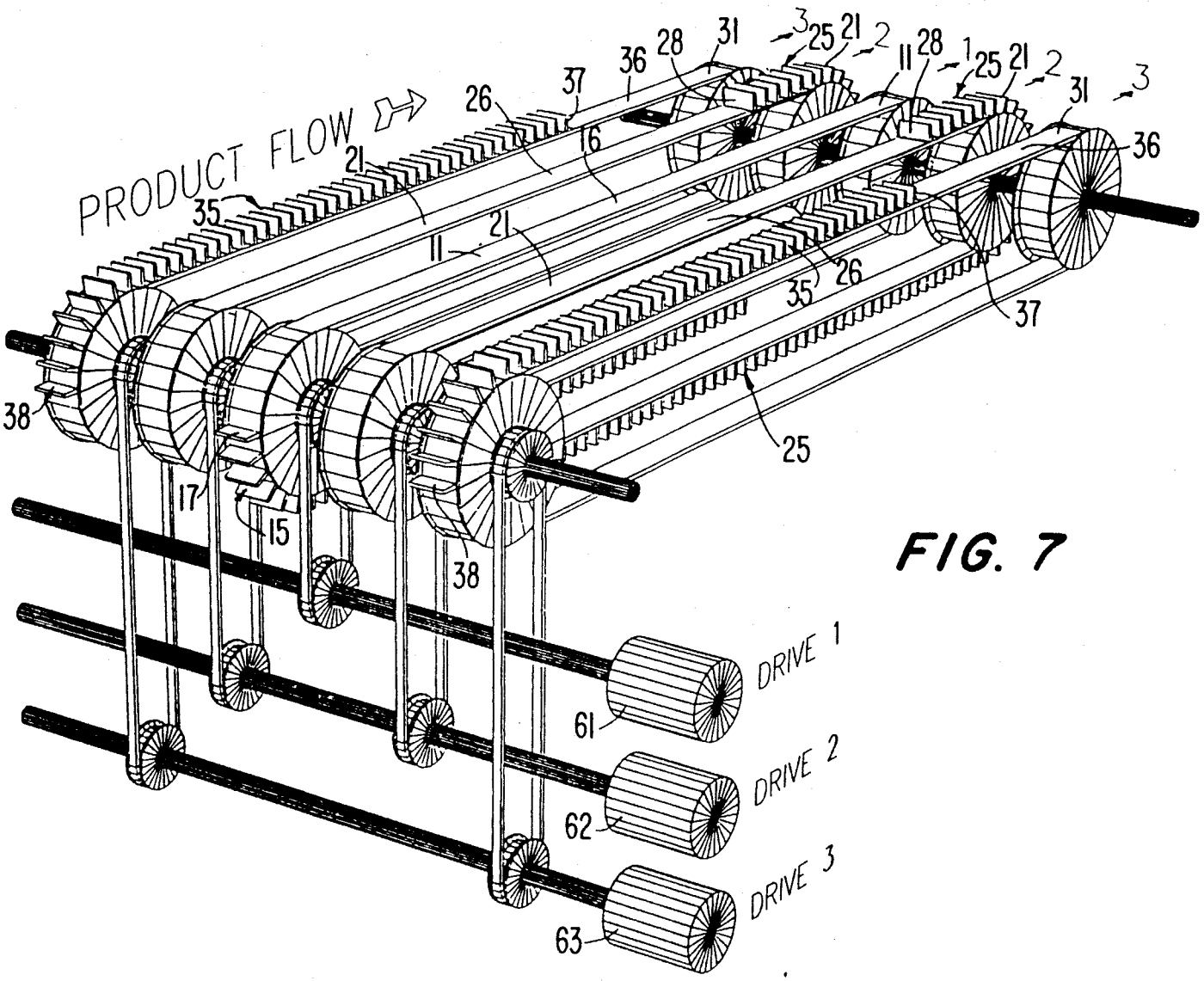
Figure 8:
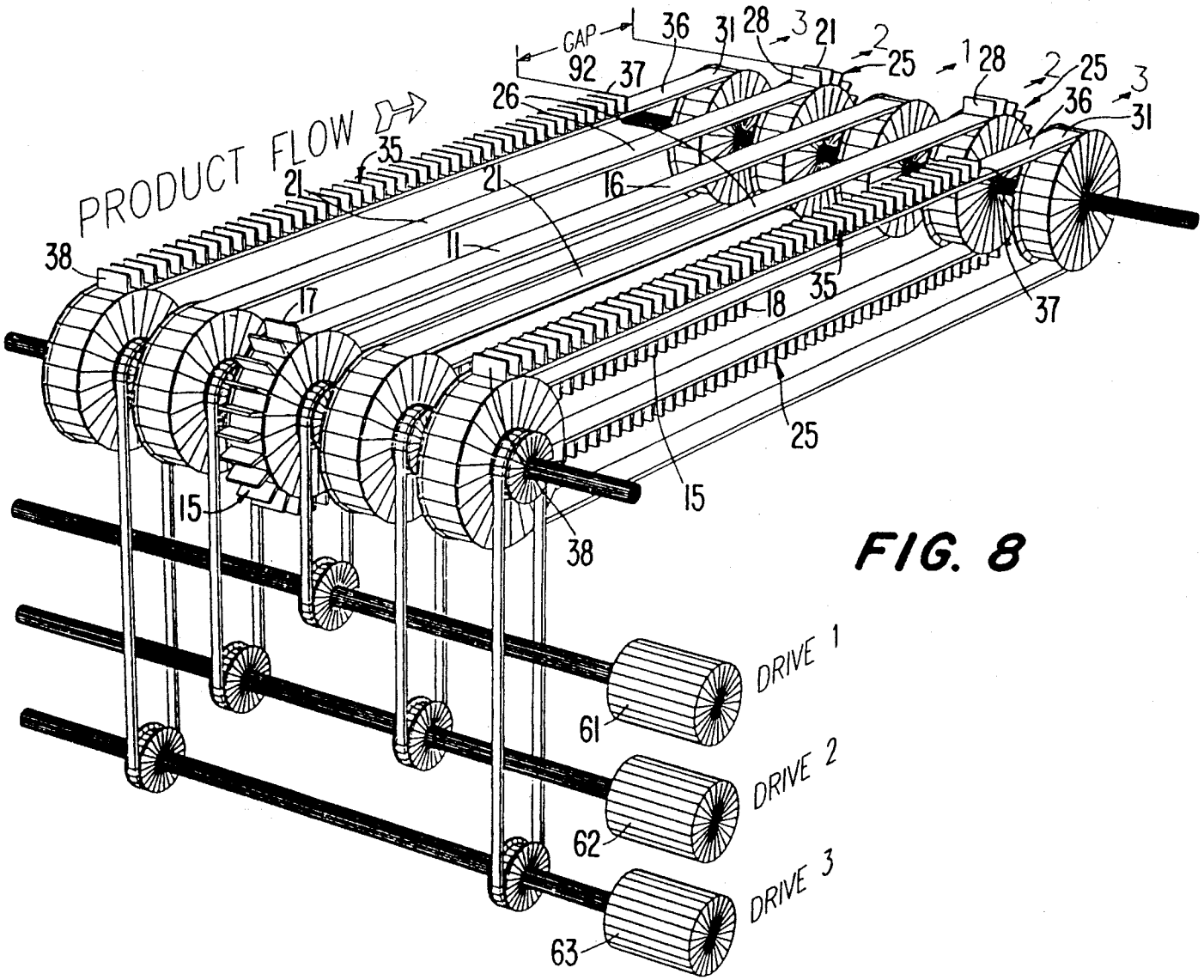

The growth of this gap 92 in the sequence of FIGS. 6, 7 and 8 can be seen by focusing on the growing distance between the trailing edge 28 of the raised portion 25 of the second conveyor belt 21 and the leading edge 37 of the raised portion 35 of the third conveyor belt 31.

Figure 17:
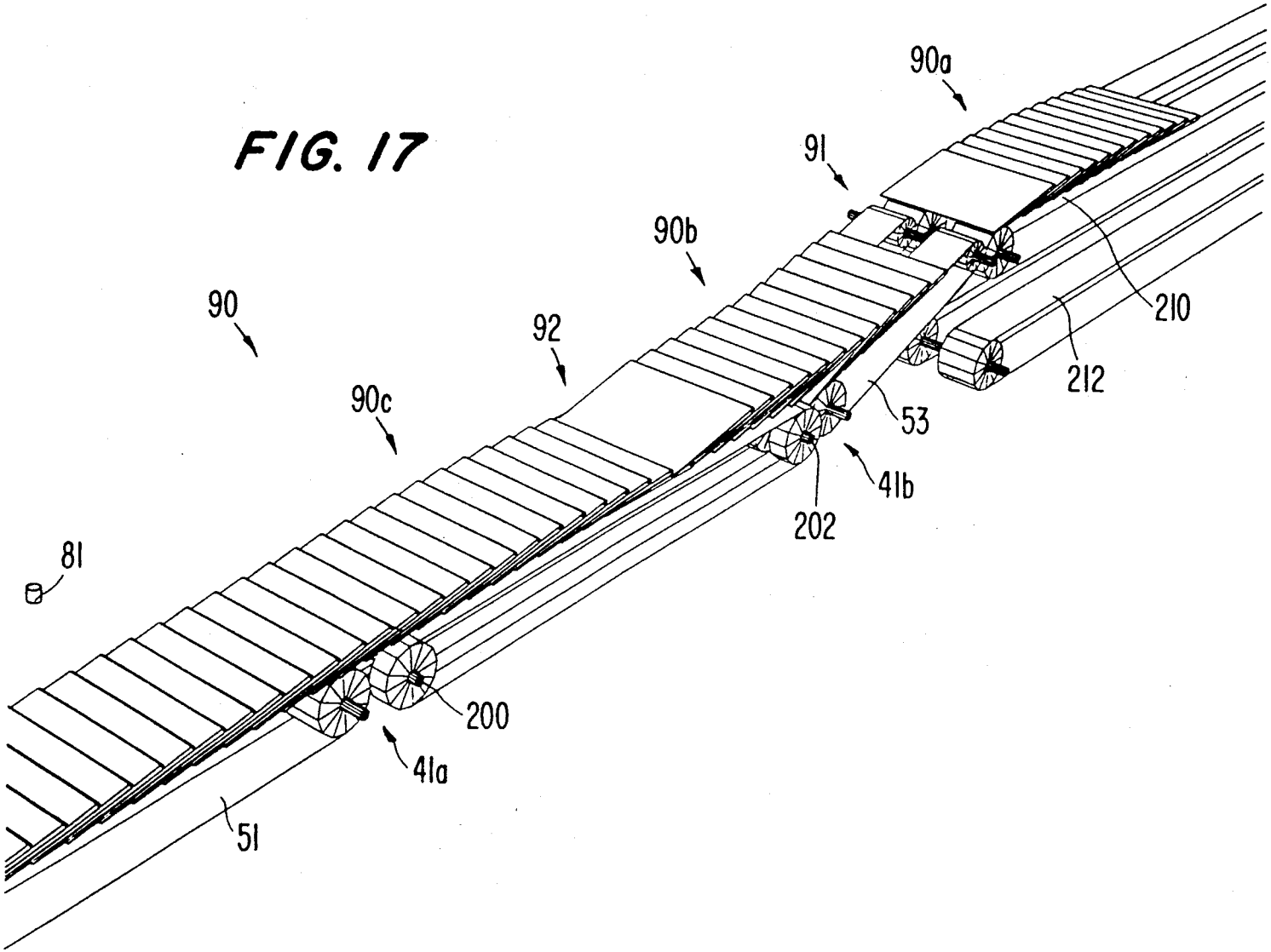
Figure 18:
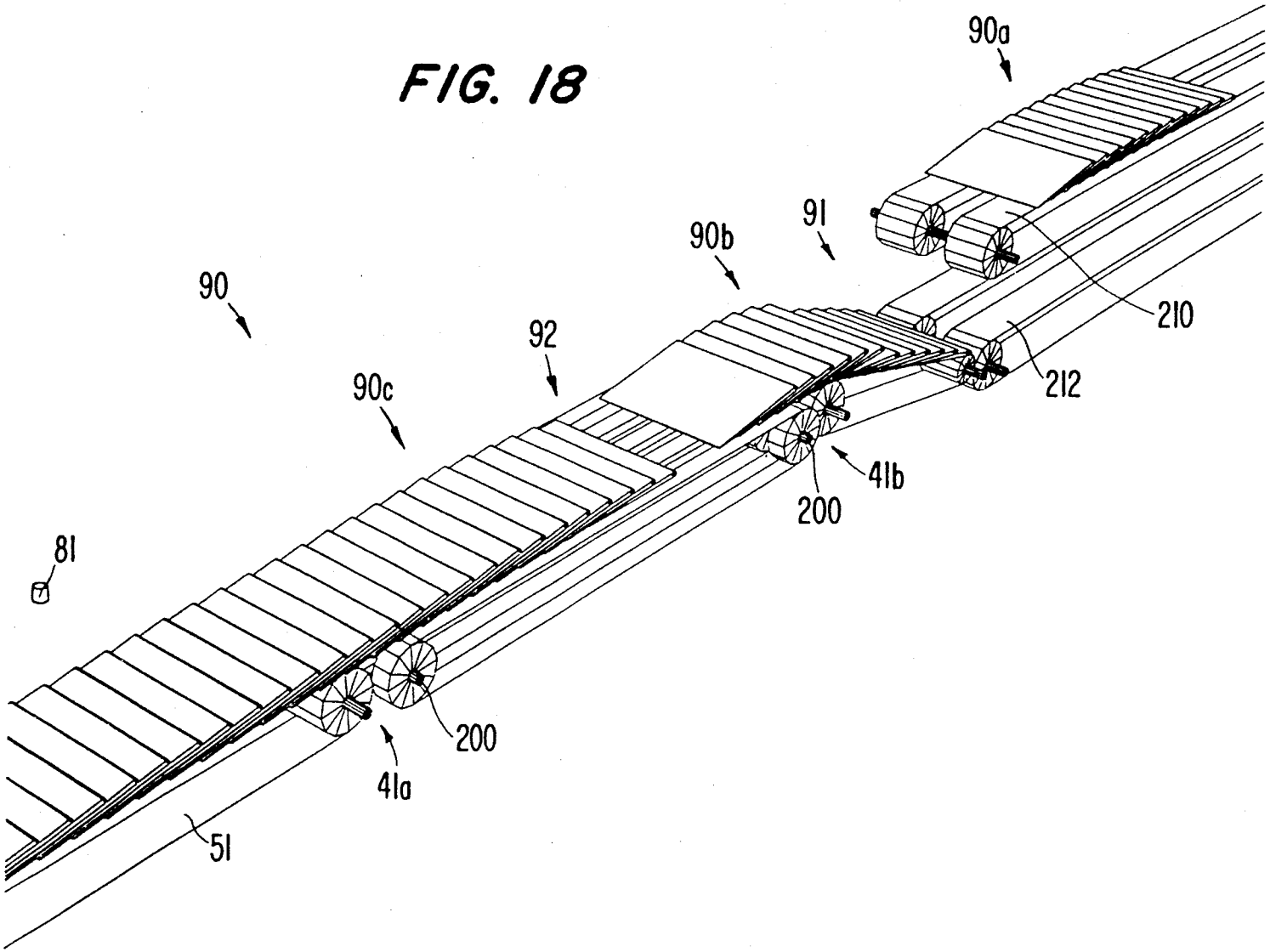

The arrangement of signatures shown in FIG. 16 corresponds to the position of the conveyors shown in FIG. 6, and the arrangement of signatures shown in FIGS. 17 and 18 correspond to subsequent positions of the conveyors somewhere around that shown in FIG. 7. As shown in FIG. 16, a second portion 90*b* of signatures is engaged by raised portions 25 of second conveyor belts 21, and a third portion 90*c* of signatures is just becoming engaged by raised portions 35 of third conveyor belts 31. In the sequence between FIGS. 16 and 17, a second discrete batch of signatures is created by second portion 90*b* of signatures on second conveyor belts 21, traveling at speed $V_2$.

In FIGS. 17–18, second conveyor belts 21, traveling at speed $V_2$, discharges the second portion 90*b* of signatures, in the form of a discrete batch, onto outfeed belts 53, which also are traveling at speed $V_2$. During this time, third conveyor belts 31 are traveling at speed $V_1$, still receiving, engaging and transporting stream of signatures 90 on raised portions 35.

When the conveyors are in the position shown in FIG. 7, microprocessor 60 commands first servomotor 61 to accelerate first conveyor belt 11 from the ready position to speed $V_1$, which is reached by the time the conveyors are in the position shown in FIG. 8. Between the positions shown in FIGS. 7 and 8, leading edge 17 of raised portion 15 of first conveyor belt 11 moves substantially in alignment with trailing edges 38 of raised portions 35 of third conveyor belts 31 so that raised portion 15 of first conveyor belt begins engaging signatures without any disruption of the stream.

When the conveyors are in the position shown in FIG. 8, and the raised portion 15 of first conveyor belt 11 begins engaging signatures, microprocessor 60 commands third servomotor 63 to accelerate third conveyor belts 31 from speed $V_1$ to speed $V_2$ while continuing to command first servomotor to drive first conveyor belt 11 at the slower speed $V_1$. As third conveyor belts 31 begin to move faster than first conveyor belt 11, a gap 93 begins to grow between the raised portions 35 of third conveyor belts 31 and raised portion 15 of first conveyor belt 11. Accordingly, a gap 93 grows between signatures carried by the raised portions 35 of third conveyor belts 31 and the signatures carried by the raised portion 15 of first conveyor belt 11.

Figure 9:
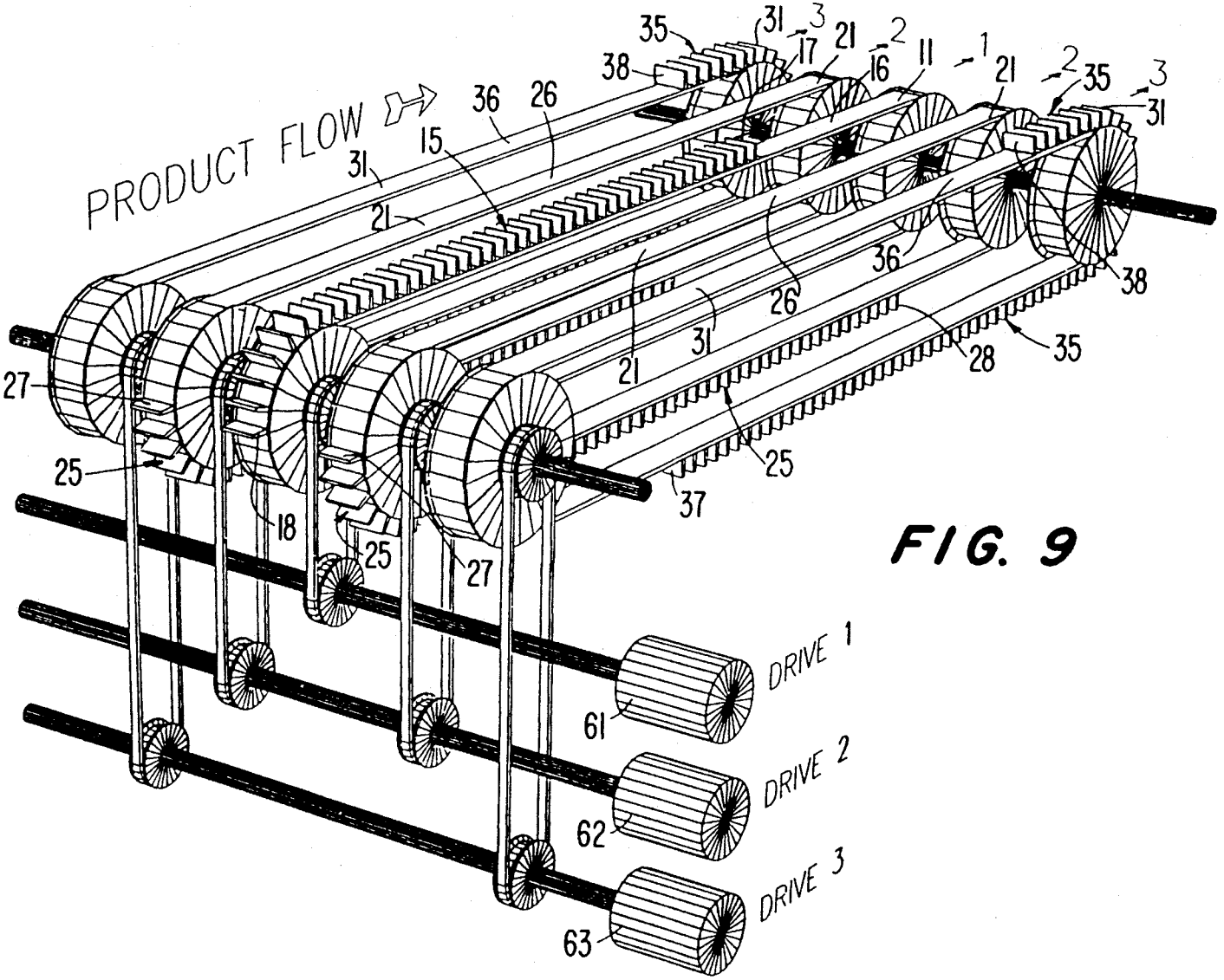
Figure 10:
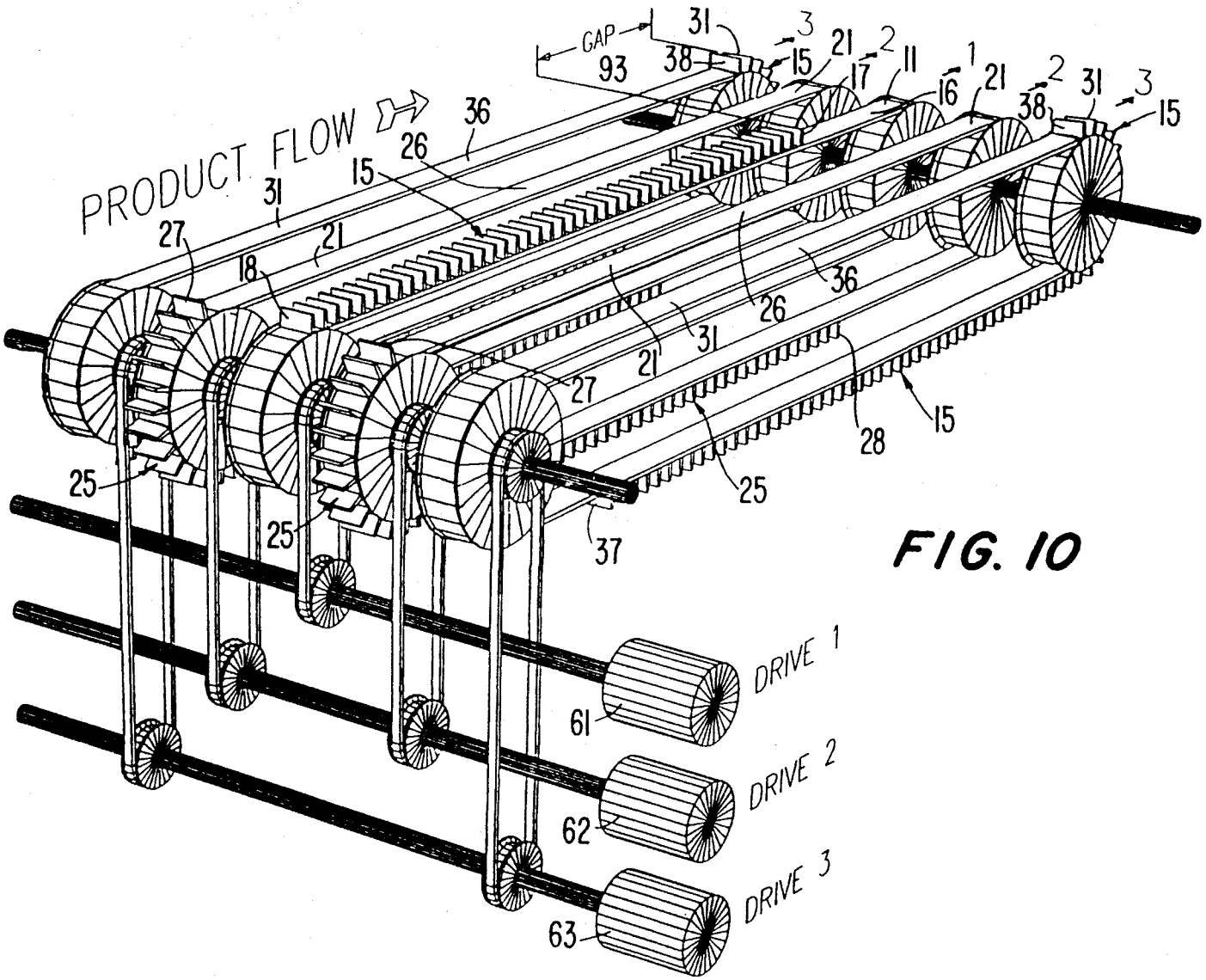

The growth of this gap 93 in the sequence of FIGS. 8, 9, and 10 can be seen by focusing on the growing distance between the trailing edges 38 of the raised portions 35 of the third conveyor belts 31 and the leading edge 17 of the raised portion 15 of the first conveyor belt 11.

Figure 19:
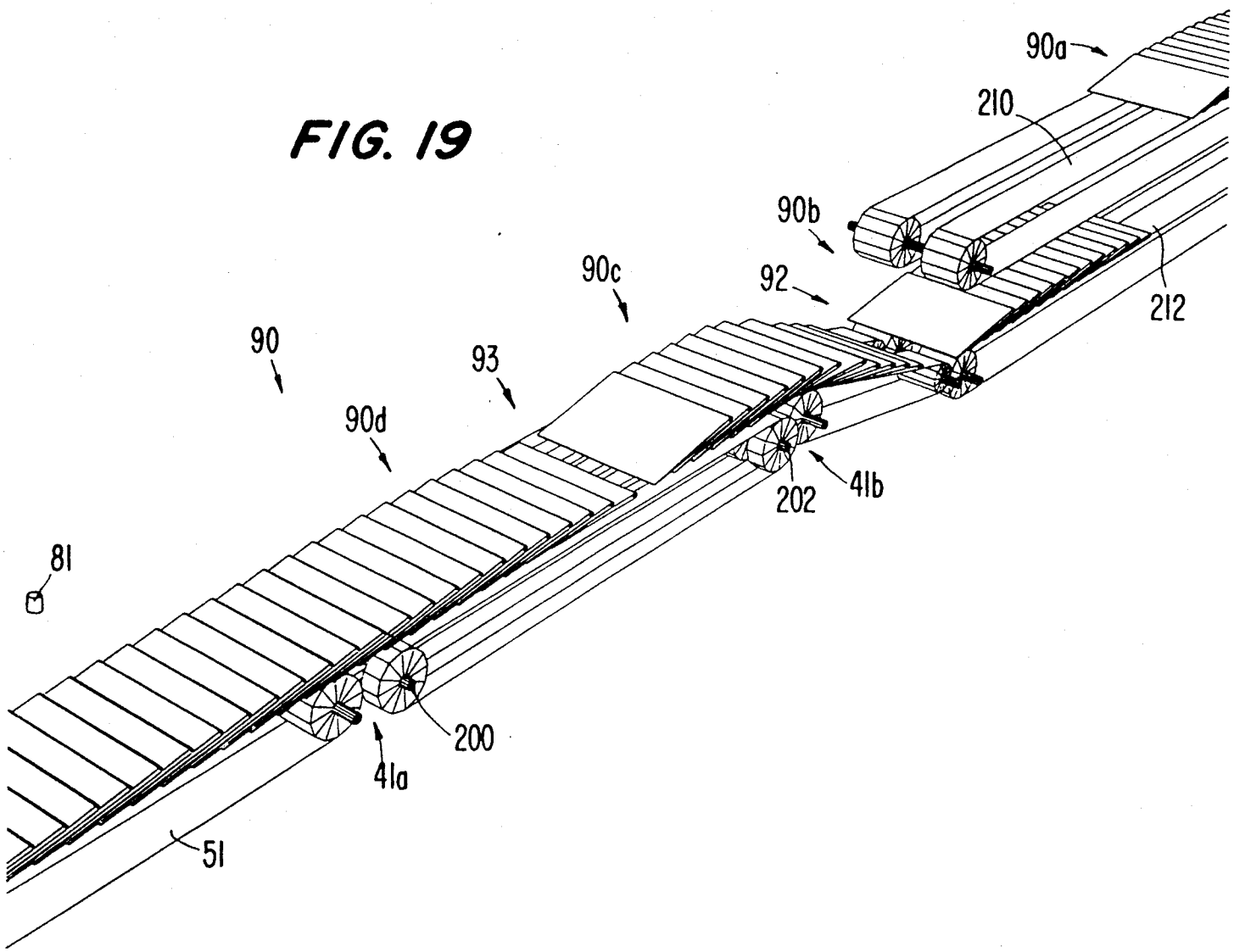
Figure 20:
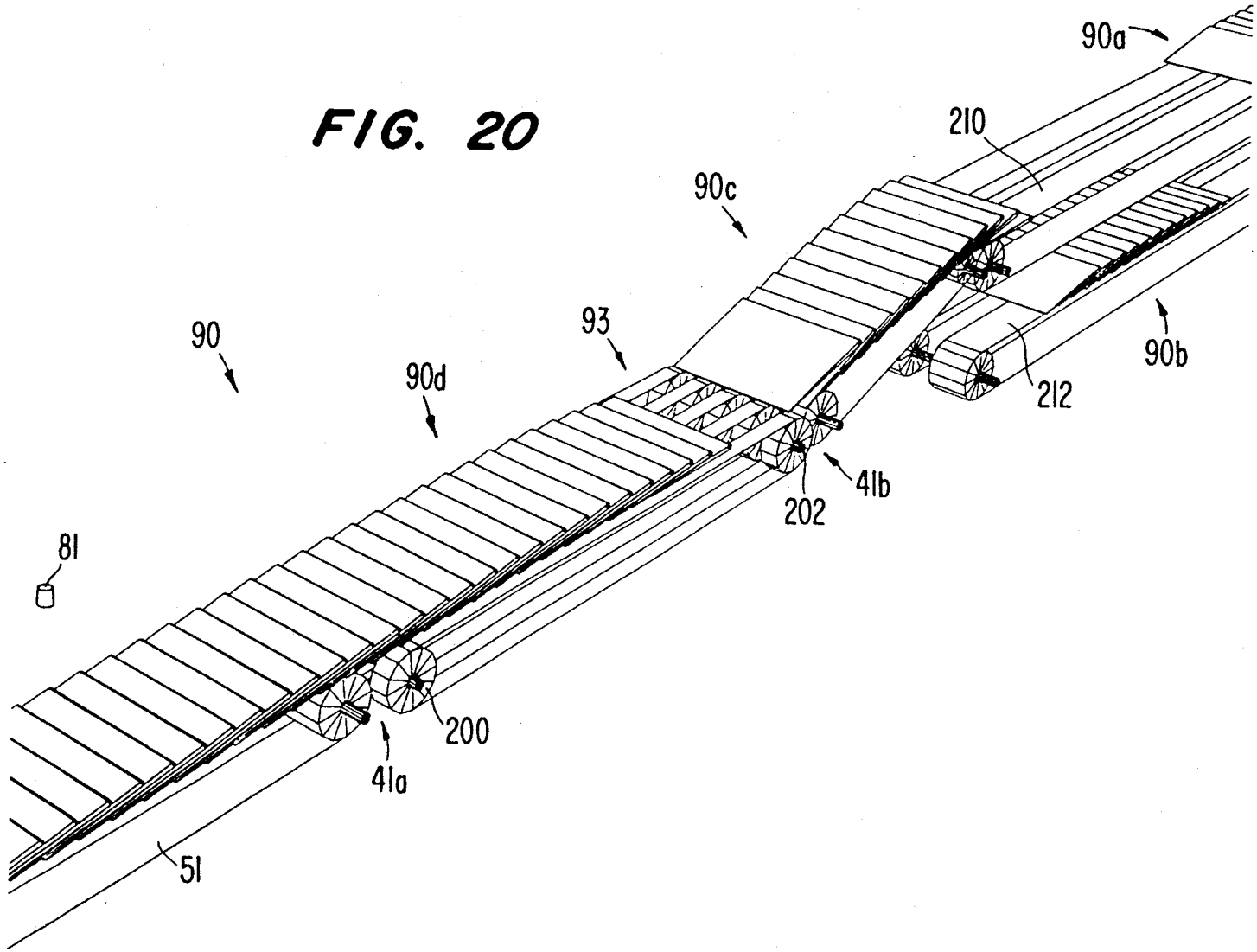

The arrangement of signatures shown in FIG. 19 corresponds to the position of the conveyors shown in FIG. 9, and the arrangement of signatures shown in FIG. 20 corresponds to a subsequent position of the conveyors shown in FIG. 10. As shown in FIG. 19, a third portion 90*c* of signatures is engaged by the raised portion 35 of third conveyor belt 31, and a fourth portion 90*d* of signatures is engaged by raised portion 15 of first conveyor belt 11. Thus a third discrete batch of signatures is formed by third portion 90*c* of signatures on third conveyor belts 31, traveling at speed $V_2$.

In the sequence between FIGS. 19 and 20, third conveyor belt 31, traveling at speed $V_2$, discharges the third portion 90*c* of signatures, in the form of a discrete batch, onto outfeed belts 53, which also are traveling at speed $V_2$. During this time, first conveyor belt 11 is traveling at speed $V_1$, and is still receiving, engaging and transporting stream of signatures 90 on raised portion 15.

The process recited above and shown in FIGS. 5–10 is repeated successively for each subsequent cycle of the belts. The increase in velocity of any belt which has fully engaged signatures with its raised portion to velocity $V_2$ successively and repeatedly introduces gaps in the streams of signatures 90 to create a sequence of discrete batches, continually delivered to outfeed conveyor 53 at velocity $V_2$. The initiation steps shown in FIGS. 1–4 are used only when the stream of signatures first arrives at the batching apparatus. It is preferable to use at least three conveyors, to permit one of the conveyors to be ready to enter the stream while the other conveyors are transporting and dividing the stream.

In practice, certain physical variables of the disclosed invention directly effect the size of the gap between discrete batches. Such variables include the nose length (NL), namely the distance between the leading edge of the first signature in a batch and the leading edge of the last signature of that batch, infeed velocity $V_1$, outfeed velocity $V_2$, and the amount of lap (L) between individual signatures. The size of the gap (G) in inches is measured by the following equation:

$$G = 12V_2\left[\frac{(0.083334\,(L + NL)}{V_1} - NL\right] - 12$$

As shown in FIGS. 13–20, it is desirable to switch the outfeed of the batching apparatus between different downstream lines 210 and 212 during the time when a gap between batches exists between the outfeed conveyor 53 and the split downstream lines 210 and 212. This allows the batches alternatively to be sent to different downstream lines without disrupting the stream of signatures. By knowing the size and speed of the gap, the required time interval for switching the outfeed conveyor 53 between downstream conveyors 210 and 212 can be calculated. An example follows.

Infeed velocity $V_1$ is set at 300 feet per minute. Each belt is designed to have a raised portion 48 inches in length, making the nose length NL equal to 48 inches. The belts are circulated around pulleys having centers spaced 55 inches. Signatures are placed on the infeed belt with a 3 inch lap L between individual signatures. Outfeed velocity $V_2$ is set at 400 feet per minute. Referring to the equation above, the apparatus separates the incoming stream of signatures into continuous successive discrete batches having an 8 inch gap G between them. With signatures moving at the speeds indicated, the calculated gap of 8 inches corresponds to 100 milliseconds of time for the gap to travel past a given point on its path.

In the sequence between FIGS. 17 and 18, the gap would exist for 100 milliseconds of time at the downstream end of outfeed conveyor 53. During this time, the outfeed conveyor 53 and the batch succeeding the gap is switched between downstream conveyors 210 and 212 to divide the batched stream of signatures without changing the speed or lap of the signatures in each batch. Batches are alternatively deposited on conveyors 210 and 212, each running at constant speed $V_2$, by powering a piston and cylinder, or other motive device 214 shown in control diagram of FIG. 22, to move outfeed conveyor 53 in alignment with these two conveyors in alternating fashion. This is automatically done through the use of encoders on the conveyors and microprocessor 60 which controls piston and cylinder 214.

Figure 23:
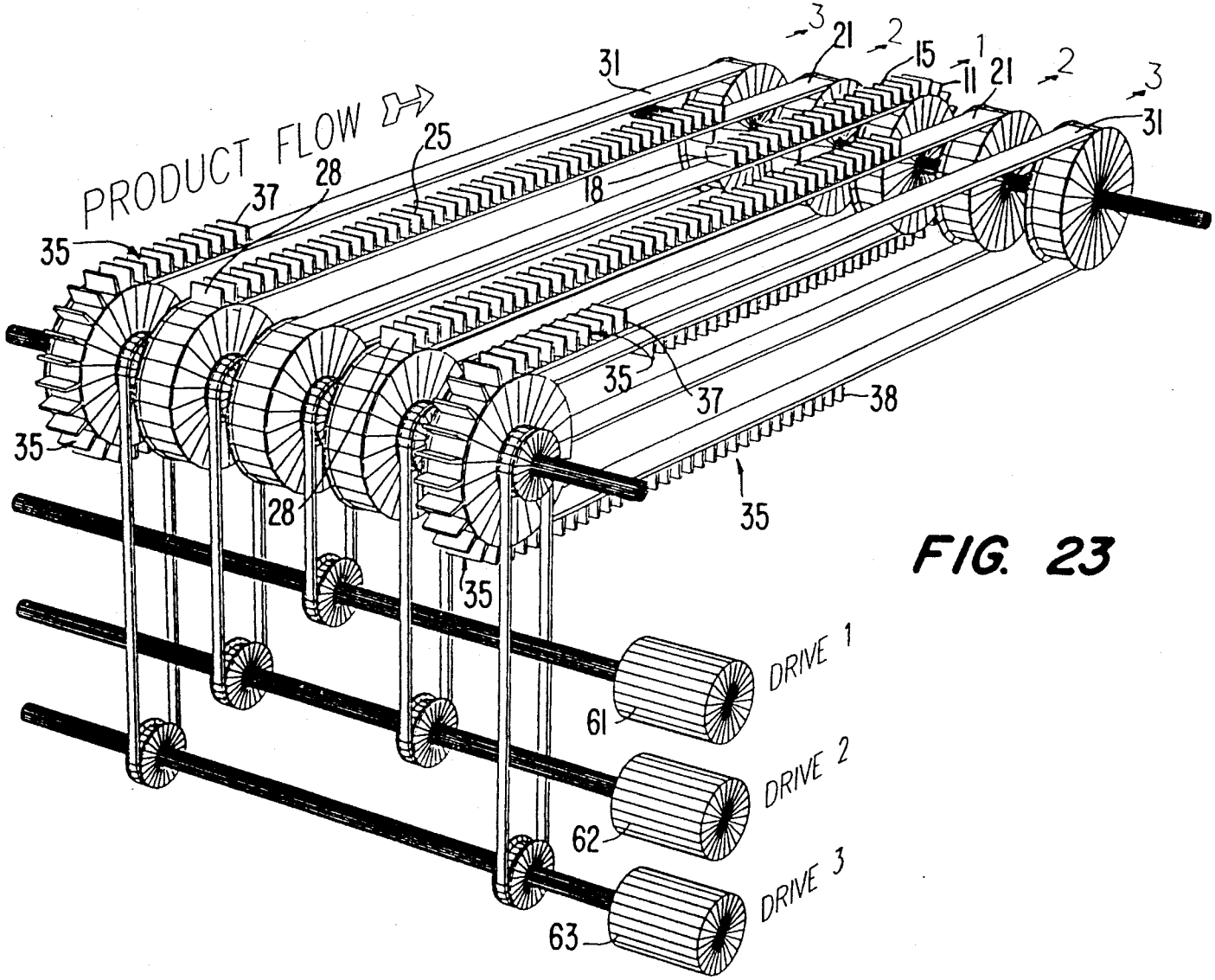
FIG. 23 is a perspective view of a method of operating the apparatus of FIGS. 1-20 in a non-batching mode.

Conveyors 10, 20, and 30 may also be used in a mode in which batching does not occur. Namely, they may be used as a single speed conveyor to convey overlapped signatures from an infeed to an outfeed. The raised portions of each conveyor are slightly longer than one third of the total peripheral length of the conveyor. When the three belts are slightly overlapped a continuous surface is available for transportation. For this nonbatching mode, the conveyors are run together in this slightly overlapped arrangement at a common speed as shown in FIG. 23.

Figure 21:
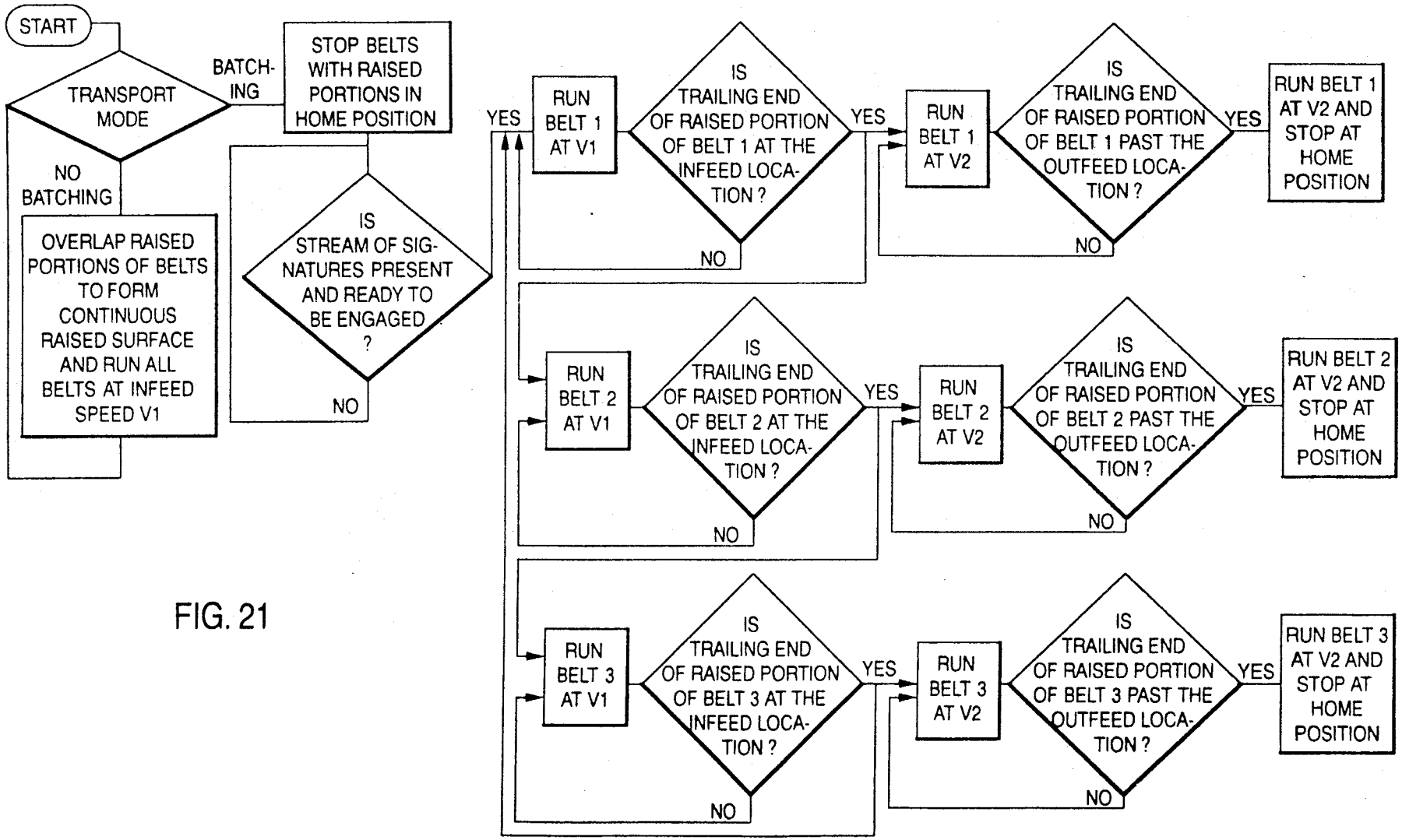
FIG. 21 is a software flow diagram for the process and apparatus of FIGS. 1-20.

The presently preferred software flow diagram is shown in FIG. 21. Other software routines may also be used to control the apparatus.

Additional advantages and modifications will readily occur to those skilled in the art. The invention in its broader terms is therefore, not limited to the specific details, representative apparatus, and illustrative examples shown and described. Accordingly departures may be made from such details without departing from the spirit of the applicants' general inventive concept.

What is claimed is:

1. An apparatus for separating a stream of lapped signatures into discrete batches of lapped signatures, comprising:

a plurality of conveyors, each for receiving, engaging and transporting a portion of the stream of lapped signatures from an infeed location to an outfeed location while maintaining the portion of lapped signatures in lapped form and discharging the portion of lapped signatures generally along the direction in which the lapped signatures are transported by the conveyors; and means for repeatedly and successively driving each of the plurality of conveyors alternately at a first speed to engage a portion of the lapped signatures and at a second speed greater than the first speed to separate the portion of lapped signatures which it is engaging from a succeeding portion of lapped signatures being conveyed by another of the plurality of conveyors, and to discharge each successive portion of lapped signatures at the outfeed location along the direction in which the lapped signatures are transported by the conveyor at a substantially constant speed which is greater than the first speed.

2. The apparatus of claim 1, including means for constantly transporting the signatures to the infeed location at the first speed.

3. The apparatus of claim 1, including means for constantly transporting the signatures from the outfeed location at the substantially constant speed which is greater than the first speed.

4. The apparatus of claim 1, wherein the plurality of conveyors include at least three conveyors.

5. The apparatus of claim 1, wherein each of the plurality of conveyors includes at least one endless belt for engaging and transporting signatures.

6. The apparatus of claim 5, wherein each of the belts includes a portion for engaging and transporting signatures and a portion which does not engage and transport signatures.

7. The apparatus of claim 6, wherein the portion for engaging and transporting signatures is a raised portion.

8. The apparatus of claim 1, wherein the plurality of conveyors are positioned alongside each other.

9. The apparatus of claim 1, wherein the plurality of conveyors include spaced pairs of commonly driven belts.

10. The apparatus of claim 9, wherein the pairs of belts are in a bilaterally symmetrical arrangement.

11. The apparatus of claim 6, wherein the portion of each belt for engaging and supporting signatures is at the same elevation so that each batch may be conveyed at the same elevation.

12. The apparatus of claim 6, wherein the portion of each belt for engaging and supporting signatures is the same length so that each batch may be the same length.

13. The apparatus of claim 6, wherein the portion of each belt for engaging and supporting signatures is the same length and at the same elevation so that each batch may be conveyed at the same elevation and may be the same length.

14. The apparatus of claim 6, including means for transporting signatures to the infeed location, wherein the portion of each belt for engaging and supporting signatures is at the same elevation as the means for transporting signatures to the infeed location so that the signatures do not vary in elevation when transferred from the means for transporting signatures to the infeed location.

15. The apparatus of claim 7, including a table with channels for supporting the belts and for permitting only the raised portions of the belts to extend above the channels.

16. The apparatus of claim 1, wherein the driving means includes a servosystem including a plurality of servomotors, each for driving one of the plurality of conveyors.

17. The apparatus of claim 5, wherein the driving means includes a servosystem including a plurality of servomotors, each for driving at least one of the belts.

18. The apparatus of claim 17, wherein each of the servomotors is positively linked to the belts which it drives.

19. The apparatus of claim 1, including means for monitoring the speed and presence of the stream of signatures upstream of the infeed location.

20. An apparatus for separating a stream of lapped signatures into discrete batches of lapped signatures, comprising:

a plurality of endless belts positioned alongside each other for transporting a portion of the stream of lapped signatures from an infeed location to an outfeed location while maintaining the portion of lapped signatures in lapped form and discharging the portion of lapped signatures generally along the direction in which the lapped signatures are transported by the conveyors, each belt including a portion for receiving, engaging and transporting lapped signatures and a portion which does not engage and transport lapped signatures; and means for repeatedly and successively driving each of the plurality of belts alternately at a first speed to engage a portion of the lapped signatures and at a second speed greater than the first speed to separate the portion of lapped signatures which it is engaging from a succeeding portion of lapped signatures being conveyed by another of the plurality of belts, and to discharge each successive portion of lapped signatures at the outfeed location along the direction in which the lapped signatures are transported by the conveyor at a substantially constant speed which is greater than the first speed.

21. The apparatus of claim 20, wherein the portion for engaging and transporting signatures is a raised portion.

22. The apparatus of claim 20, wherein the plurality of conveyors include spaced pairs of commonly driven belts.

23. The apparatus of claim 22, wherein the pairs of belts are in a bilaterally symmetrical arrangement.

24. The apparatus of claim 20, wherein the portion of each belt for engaging and supporting signatures is at the same elevation so that each batch may be conveyed at the same elevation.

25. The apparatus of claim 20, wherein the portion of each belt for engaging and supporting signatures is the same length so that each batch may be the same length.

26. The apparatus of claim 20, wherein the portion of each belt for engaging and supporting signatures is the same length and at the same elevation so that each batch may be conveyed at the same elevation and may be the same length.

27. The apparatus of claim 20, including means for transporting signatures to the infeed location, wherein the portion of each belt for engaging and supporting signatures is at the same elevation as the means for transporting signatures to the infeed location so that the signatures do not vary in elevation when transferred from means for transporting signatures to the infeed location.

28. The apparatus of claim 21, including a table for supporting the belts.

29. The apparatus of claim 21, including a table with channels for supporting the belts and for permitting only the raised portions of the belts to extend above the channels.

30. The apparatus of claim 20, wherein the driving means includes a servosystem including a plurality of servomotors, each for driving at least one of the belts.

31. The apparatus of claim 30, wherein each of the servomotors is positively linked to the belts which it drives.

32. The apparatus of claim 20 wherein the driving means alternatively drives the plurality of conveyors at a common speed to convey the stream of signatures without batching.

33. A method for separating a stream of lapped signatures into discrete batches of lapped signatures, comprising the steps of:

receiving a stream of lapped signatures at an infeed location;

transporting successive portions of the stream of lapped signatures from the infeed location at a first speed on respective successive conveyors;

repeatedly and successively accelerating each portion of lapped signatures and its respective conveyor to a second speed greater than the first speed to separate it from the succeeding portion of lapped signatures and form a discrete batch of lapped signatures; and discharging the discrete batches of lapped signatures from their respective conveyors at an outfeed location generally along the direction in which the lapped signatures are transported by the conveyors at a substantially constant speed which is greater than the first speed.

34. The method of claim 33 wherein the transporting and accelerating steps are performed by circulating endless conveyor belts.

35. The method of claim 33 including maintaining each portion of the signatures at the same elevation between the infeed location and the outfeed location.

36. The method of claim 33 wherein the transporting and accelerating steps are performed by circulating endless conveyor belts which are positioned alongside each other.

37. The method of claim 36 wherein each of the belts includes a portion for engaging and transporting signatures and a portion which does not engage and transport signatures.

38. The method of claim 37 wherein the portion for engaging and transporting signatures is a raised portion.

39. The method of claim 37 including separating the stream of signatures into portions of equal length with equal length belt portions for engaging and transporting signatures.

40. The method of claim 33 including maintaining the signatures at the same elevation during the receiving step.

41. The method of claim 33 including maintaining the signatures at the same elevation during the discharging step.

42. The method of claim 38 wherein the method alternatively includes driving the plurality of conveyors at a common speed with the raised portions staggered and overlapped to convey the stream of signatures without batching.

43. A method for separating a stream of lapped signatures into discrete batches of lapped signatures, comprising the steps of:

receiving a stream of lapped signatures travelling at a first speed at an infeed location;

transporting successive portions of the stream of lapped signatures at the first speed from the infeed location on respective successive conveyors;

repeatedly and successively accelerating each portion of the stream of lapped signatures to a second speed and its respective conveyor while transporting a succeeding portion of lapped signatures on another conveyor at the first speed, to separate it from the succeeding portion of lapped signatures and form a discrete batch of lapped signatures; and continuously discharging the discrete batches of lapped signatures from their respective conveyors at an outfeed location at a substantially constant speed which is greater than the first speed.

44. The method of claim 43 including constantly transporting the signatures to the infeed location at the first speed.

45. The method of claim 43, including constantly transporting the signatures from the outfeed location at the substantially constant speed which is greater the first speed.

* * * * *